US011084614B2

(12) United States Patent
Wiest

(10) Patent No.: US 11,084,614 B2
(45) Date of Patent: Aug. 10, 2021

(54) PACKAGING, A SHAPED OBJECT HAVING PACKAGING, AND A DEVICE AND METHOD FOR PRODUCING SAME

(71) Applicants: Jens Sebastian, Reutlingen (DE); Florian Wiest, Reutlingen (DE)

(72) Inventor: Florian Wiest, Reutlingen (DE)

(73) Assignees: SEBASTIAN, JENS, DR., Reutlingen (DE); FLORIAN WIEST GBR, Reutlingen (DE)

( * ) Notice: Subject to any disclaimer, the term of this patent is extended or adjusted under 35 U.S.C. 154(b) by 844 days.

(21) Appl. No.: 15/038,327

(22) PCT Filed: Nov. 19, 2014

(86) PCT No.: PCT/DE2014/100408

§ 371 (c)(1),
(2) Date: Sep. 1, 2016

(87) PCT Pub. No.: WO2015/074644

PCT Pub. Date: May 28, 2015

(65) Prior Publication Data

US 2016/0362209 A1 Dec. 15, 2016

(30) Foreign Application Priority Data

Nov. 21, 2013 (DE) ..... 10 2013 112 869.6

(51) Int. Cl.
*B65B 47/10* (2006.01)
*B65B 51/22* (2006.01)
(Continued)

(52) U.S. Cl.
CPC ..... *B65B 47/10* (2013.01); *B65B 3/02* (2013.01); *B65B 51/22* (2013.01); *B65B 61/18* (2013.01);
(Continued)

(58) Field of Classification Search
CPC ..... B65B 47/10; B65B 51/22; B65B 3/02; B65B 61/18; B65B 3/027; B65B 7/16;
(Continued)

(56) References Cited

U.S. PATENT DOCUMENTS 4,058,212 A * 11/1977 Wyslotsky ..... B65D 75/32 206/470
4,884,718 A * 12/1989 Leahy ..... B65D 43/162 220/835
(Continued)

FOREIGN PATENT DOCUMENTS

EP 0 223 581 A2 5/1987
EP 0 459 818 A1 12/1991
(Continued)

OTHER PUBLICATIONS

International Search Report for corresponding International Application No. PCT/DE2014/100408 dated Apr. 28, 2015.

*Primary Examiner* — Nathaniel C Chukwurah
*Assistant Examiner* — Mobeen Ahmed
(74) *Attorney, Agent, or Firm* — Renner, Otto, Boisselle & Sklar, LLP

(57) ABSTRACT

A method for producing a packaging, and in particular a film packaging having a bubble-like receiving cavity, in particular for producing a blister pack, comprising the following steps: overlapping at least two film elements, shaping at least one receiving cavity for receiving at least one object to be packaged between the overlapping film elements, and connecting the at least two film elements along a shared sealed edge region extending at least partially around the periphery of the receiving cavity, and in particular by way of at least one sealing weld joint, so as to seal the receiving cavity, wherein the two film elements are designed without any intermediate space on the sealing edge region projecting from the same, wherein opening means, which allow simplified access to the receiving cavity, are provided.

10 Claims, 8 Drawing Sheets

(51) Int. Cl.

| | |
|---|---|
| ***B65D 75/32*** | (2006.01) |
| ***B65D 75/58*** | (2006.01) |
| ***B65B 3/02*** | (2006.01) |
| ***B65B 61/18*** | (2006.01) |
| ***B65D 75/22*** | (2006.01) |
| *B65B 7/16* | (2006.01) |
| *B65B 47/04* | (2006.01) |
| *B65B 47/08* | (2006.01) |

(52) U.S. Cl.
CPC ..... *B65D 75/22* (2013.01); *B65D 75/322* (2013.01); *B65D 75/585* (2013.01); *B65D 75/5855* (2013.01); *B65B 3/022* (2013.01); *B65B 3/027* (2013.01); *B65B 7/16* (2013.01); *B65B 47/04* (2013.01); *B65B 47/08* (2013.01); *B65B 61/184* (2013.01); *B65D 2575/329* (2013.01); *B65D 2575/3227* (2013.01); *B65D 2575/3236* (2013.01); *B65D 2575/3245* (2013.01)

(58) Field of Classification Search
CPC ..... B65B 3/022; B65B 47/00; B65B 47/04; B65B 47/08; B65B 61/184; B65D 75/22; B65D 75/322; B65D 75/585; B65D 75/5855; B65D 2575/3227; B65D 2575/3236; B65D 2575/3245; B65D 2575/329; B65D 73/00; B65D 33/00; B65D 35/00; B65D 75/00
USPC ... 53/452, 453, 558, 559, 410, 133.1, 133.3; 206/484–484.2, 463; 604/408–416
See application file for complete search history.

(56) References Cited

U.S. PATENT DOCUMENTS 5,129,516 A * 7/1992 Theros ..... B65D 75/225 206/463
5,535,885 A * 7/1996 Daniel ..... B65D 1/095 206/484
5,609,246 A 3/1997 Borghorst et al.
6,517,526 B1 * 2/2003 Tamari ..... A01N 1/0236 604/403
7,552,823 B2 * 6/2009 Schuehrer ..... A45D 34/04 206/469
8,578,684 B2 * 11/2013 Greenland ..... B65B 47/08 53/410
9,216,849 B2 * 12/2015 Pham ..... B65D 43/162
9,272,830 B2 * 3/2016 Greenland ..... B65B 47/08
2003/0085298 A1 * 5/2003 Schuehrer ..... A45D 34/02 239/34
2003/0185942 A1 * 10/2003 Bishop ..... B65D 85/812 426/77
2004/0016771 A1 * 1/2004 Redmond ..... B65D 55/16 222/92
2009/0113753 A1 * 5/2009 Pepper ..... A61J 1/1475 34/284
2012/0241346 A1 9/2012 Wiest
2012/0241347 A1 * 9/2012 Bowers ..... B65D 75/327 206/469
2012/0325713 A1 * 12/2012 Cramblet ..... B65D 73/0092 206/463
2013/0221037 A1 * 8/2013 Klenovich ..... B65D 35/00 222/420
2014/0008366 A1 * 1/2014 Genosar ..... A61M 5/2066 220/265
2014/0053952 A1 * 2/2014 Genosar ..... A61M 5/2448 141/105
2014/0262906 A1 * 9/2014 Le ..... B65D 83/0463 206/461
2014/0346071 A1 * 11/2014 Genosar ..... B65D 25/02 206/438
2015/0203223 A1 * 7/2015 Ehrmann ..... B65B 7/164 493/52
2016/0280440 A1 * 9/2016 von Sybel ..... B65B 61/02

FOREIGN PATENT DOCUMENTS

EP 0 680 895 A1 11/1995
WO WO 94/07761 A1 4/1994
WO WO 2013/156747 A2 10/2013

* cited by examiner

Fig. 10
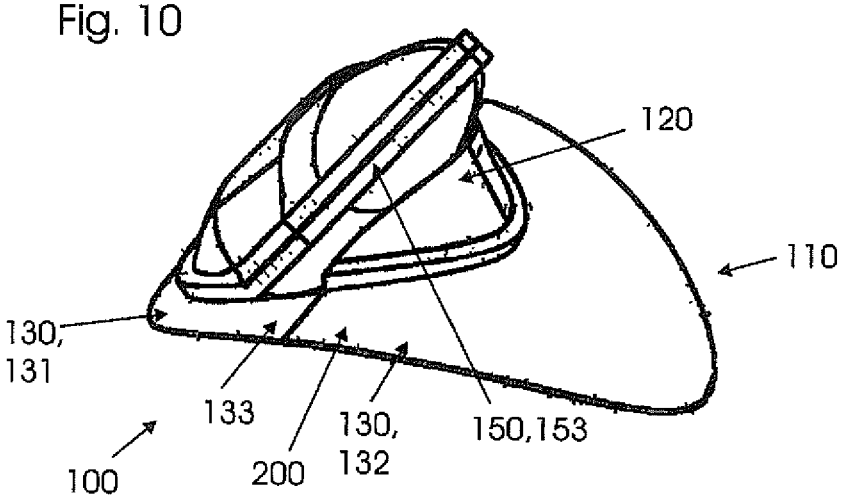
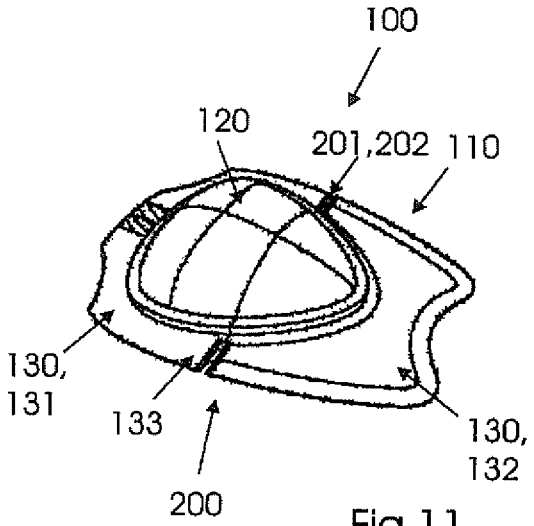
Fig.11
Fig. 12
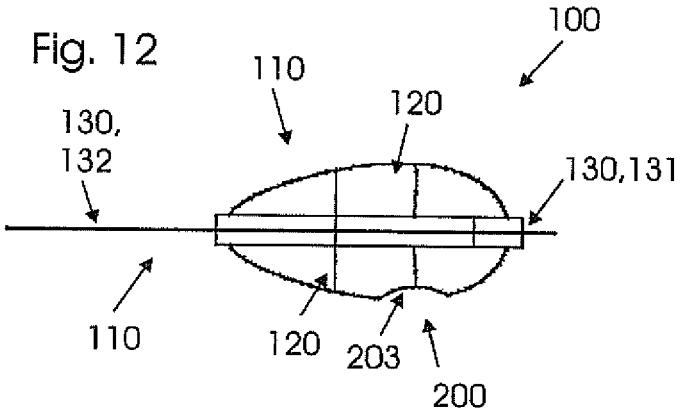

PACKAGING, A SHAPED OBJECT HAVING PACKAGING, AND A DEVICE AND METHOD FOR PRODUCING SAME

TECHNICAL FIELD OF INVENTION

The invention relates to a method for producing a packaging, in particular a film packaging having a bubble-like receiving cavity, in particular for producing a blister pack.

The invention further relates to a method for producing a packaged shaped object, and in particular a packaged object suitable for consumption, such as a food and/or a food product and/or a dietary supplement.

The invention also relates to a packaging as described herein.

Moreover, the invention relates to a shaped object including a packaging.

The invention additionally relates to a device for producing at least one packaging.

And last but not least, the invention relates to a device for producing at least one shaped object including packaging.

DISCUSSION OF RELATED ART

Methods and devices for producing packagings and packaged objects by way of films are generally known. In particular, methods and devices for producing blister packs are known. Plastic films are used for this purpose, which are made of polyolefins such as high- and low-density polyethylene (PE) or polypropylene (PP). In addition, films made of polyvinyl chloride (PVC), polystyrene (PS), various polyesters and polycarbonate (PC) are known. It is also possible to process other, biobased plastics such as polylactide (PLA), cellulose acetate and starch blends to obtain films, and these are used accordingly. Multi-layer composites are also frequently produced from a combination of different plastic materials. This allows certain properties, such as the permeation behavior, to be improved. Such plastic films are frequently used as packaging. A typical use of plastic films is in blister packs or high-visibility packagings. A high-visibility packaging is understood to mean a product packaging that allows the customer or buyer to view the packaged object. The object, the shaped object or the product is featured against a back panel, onto which information is usually printed, and is fixed by a shaped plastic film part. In some high-visibility packagings, the back panel is also made of plastic film, and in the case of pharmaceuticals, it is made of aluminum foil. A distinction is made between welded packagings, clamped packagings, and stapled packagings. In the case of welded packagings, the film front and film back are joined to each other by heat, at the same time sealing the product. In the case of clamped packagings, the edges of the film front are bent around the back by heating the plastic material. In the case of stapled packagings, the film front and cardboard back are joined to each other by way of staples. The shaping of the blister contour is carried out by way of thermoforming technology.

Thermoforming is a method used to form thermoplastics. This technique used to be referred to as hot forming, deep drawing or vacuum forming. Thermoforming processes are distinguished by the semi-finished products used: Thinner semi-finished products are referred to as films, thicker ones (starting at approximately 1.5 mm) as sheets. Film semi-finished products can be fed to the automatic thermoforming machine on large rolls (diameters up to 1.8 m). In addition, thermoforming molds are the tools used for thermoforming. Articles made of thin films (0.2 to 1 mm), such as inserts for chocolate boxes, packaging for Schokokuss chocolates (chocolate-covered marshmallow treats), game box inserts, clamshells for all kinds of small articles on pegboards in retail stores, yogurt or margarine cups are used widely. This also applies to slide pack blisters, formed and sealed plastic cavities, and the difficult-to-open clamshells, which are often used to sell small parts and welded together by way of radio frequency (RF) electrodes. The film is guided from large rolls, at the film web edges, by what are known as spiked chains. The cold film, which is still hard, is first fed to the automatic forming machine and then passed through the same in a cycled manner. In a heating station, radiant heaters are actuated by industrial heat control units, heating the film on one side or both sides. The warm film, which is now softer, is pulled apart slightly by the spiked guides to prevent the film from sagging too much. In the tooling station, the film is held in place by way of tenter frames, and pre-stretchers and the thermoforming mold pass through the film plane and roughly predefine the finished contour. Compressed air is then fed from one side, and a vacuum from the other side, so as to move the film rapidly and vigorously against the water-cooled wall (contour) of the aluminum forming mold. Air escapes between the film and the aluminum mold through 0.5 to 0.8 mm small holes and/or 0.2 to 0.3 mm wide slots. The cooled, now solid film is removed from the forming mold and supplied to a punching station in the next work cycle. By way of steel rule die cutting, the outside dimensions, or holes, are cut into the finished workpiece. In the next work cycle, the article is removed manually from the thermoforming machine or is automatically stacked by way of a stacking shaft, clamping board, ejector and squeegee. The finished film articles are then removed manually in stacks, frequently packaged in plastic bags and placed in boxes. In addition, there are other thermoforming types, which are only outlined briefly here: High-performance machines use annealed steel molds and punch out the film articles the same time that these are formed. Medium-lot production machines are at times also operated only with a vacuum or compressed air. Small lots are generated on a case-by-case basis from a small roll or from film sheets in semi-automatic machines, and the parts are then cut by way of a roller cutter and steel rule die. When slides and folding and rotating cores are used, it is also possible to implement complex designs. Punching can also take place in more than one plane. Packagings used to be cuboid; today, they almost always conform to the complex geometries of the articles to be packaged, or they are provided with curved surface areas and edges only so as to obtain custom "modern" packagings.

The disadvantages of blister packs are that the packaging waste is often high, in particular when the objects are small, and the environmental life cycle assessment of plastic is worse than that of cardboard. In addition, removal from blister packs is very cumbersome. The known blister packs moreover become unusable once opened, making return of the packaging more difficult. In addition, it is extremely difficult at times to open blister packs made entirely of plastic material, since the front and back sides are generally fused together, and clean and simple opening is very difficult without resources. Moreover, cut edges can result in injuries during the opening of the blister packs. After opening, the packaging waste often takes up a larger volume than when the product that was packaged. This impedes waste disposal.

SUMMARY OF THE INVENTION

It is the object of the invention to create a packaging, a shaped object including packaging, and methods and devices for the production thereof, which have improved properties over the prior art and in particular are easier to open and are environmentally sustainable. Moreover, the packagings are suitable for a plurality of objects such as candy, liquids, powder or the like. In particular, a reusable packaging is to be created.

The invention encompasses the technical teaching that, in a method for producing a packaging, and in particular a film packaging having a bubble-like receiving cavity, in particular for producing a blister pack, comprising the following steps: overlapping at least two film elements, shaping at least one receiving cavity for receiving at least one shaped object, or more concisely an object, to be packaged between the overlapping film elements, and connecting the at least two film elements along a shared sealed edge region extending at least partially around the periphery of the receiving cavity, in particular by way of at least one sealing weld, also referred to as a sealed seam, so as to seal the receiving cavity, wherein the two film elements are designed without any intermediate space on the sealed edge region projecting from the same, it is provided that opening means and/or retaining means for retaining the packaged object at least when the packaging is opened are provided, which allow simplified access to the receiving cavity, without the object inadvertently finding its way out of the receiving cavity. The retaining means are, in particular, configured or provided integrated into the packaging, and preferably into the receiving cavity. The retaining means comprise moldings, recesses, undercuts and the like, which preferably directly abut the receiving cavity. In one embodiment, the moldings protrude into the receiving cavity from the film elements. In other embodiments, the recesses on the film elements project away from the receiving cavity. When adding the object, in particular in liquid form, which is to say in a state in which the object is present in a molten state, the liquid object surrounds the retaining means. During hardening, the hardened object then further surrounds the retaining means, so that the object still adheres at least briefly to the retaining means when the packaging is being opened. The retaining means are designed such that these allow a separation from the object, for example by suitable surfaces, such as bevels, rounded regions and the like. In other embodiments, the retaining means are designed such that the object to be shaped in the receiving cavity has a predetermined breaking point, which causes the object to break when the object is removed, whereby a majority of the object is easy to remove. A minimal remainder of the object initially remains in the packaging. In one embodiment, the object remaining in the packaging can be removed after the majority of the object has been removed. In other embodiments, the remaining part is designed to be so insignificant that this remains in the packaging.

In the method, two film elements are conveyed. In one embodiment, the film elements are connected to each other and form a film web. The film is bent in a longitudinal axis oriented in a displacement direction about this axis by 180°, so that the two film halves are located opposite each other, each located on one side of the longitudinal axis.

In another embodiment, the film elements are not connected to each other. Each film element thus forms a dedicated film web, which is respectively fed. For an overlapping of the film elements, the film webs are preferably configured parallel to each other. If necessary, the film webs are synchronized by way of a synchronization device, so that corresponding parts of the film webs are aligned and/or positioned with respect to each other. Depending on the end product, the film elements, film webs, or more concisely the films, are disposed so as to be congruent or only partially overlap each other. The film elements are formed so as to create a receiving cavity between the film elements. Forming is preferably carried out by means of a thermoforming method. In this process, the film is shaped under the action of heat, which softens the film so as to deform it. This is preferably carried out by way of a forming mold or multiple forming molds, preferably in one operation and, in other embodiments, in multiple operations. In one embodiment, the films are deformed symmetrically to each other, which is to say the two film elements have the same receiving cavity contour. In another embodiment, the receiving cavity contours are configured differently for each film element. So as to create the receiving cavity by way of a forming mold, a positive pressure is generated between the films in the forming mold, which pushes the softened film elements against the contour of the forming mold. In another embodiment, a vacuum is generated between the film elements and the forming mold, which moves or deforms the film elements in the direction of the wall of the forming molds, whereby the respective receiving cavity is generated. In a preferred embodiment, the receiving cavity is closed by way of a (sealing) weld joint, also referred to as a sealed seam. The welded joint is thus preferably achieved by way of a sealed seam. In other embodiments, multiple sealed seams are provided. By way of the welded joint, one film edge, which surrounds the periphery of the receiving cavity in the plane of the film elements, is welded to the opposite film edge of the corresponding film element. In one embodiment, the sealed seam is uniformly configured along the film edge. In other embodiments, the sealed seam is configured differently along the film edge or the receiving cavity edge. The sealed seam is preferably interrupted in one location so as to create a filling orifice. In a further step, the object, or a material to be added, is introduced into the receiving cavity through this filling orifice. The receiving cavity is preferably filled with the object in a liquid or viscous form. The receiving cavity is preferably filled with the object in liquid or gaseous form. After the filling or pouring process, the filling orifice is sealed. In another embodiment, multiple filling orifices are provided. The sealed seam or the weld joint is accordingly interrupted multiple times around the periphery. The interruption can be provided in any arbitrary location. In one embodiment, the interruption of the sealed seam, or the filling orifice, is provided on a centroidal axis of the packaging. The centroidal axis is an imaginary line that, when the packaging is suspended at one end, arises from or is derived by the gravity from the suspension point along the gravity field. The centroidal axis also arises through a center of volume of the packaging along the gravity field. In a preferred embodiment, the filling orifice is created at a distance from, or offset from, and/or rotated in relation to, the centroidal axis. In one embodiment, the weld joint or the sealed seam includes reinforcements and/or weakenings. In one embodiment, a reinforcement of the sealed seam is created by way of one embossing or multiple embossings. In another embodiment, multiple sealed seam reinforcements are provided. In the region of the sealed seam reinforcement, the film elements remain connected to each other longer during opening than in other, non-reinforced sealed seam regions. In this way, the sealed seam reinforcement implements a kind of hinge for the film elements. The film elements can accordingly be separated from each other more easily in the area of a sealed seam weakening. The separation of the film elements for gaining access to the receiving cavity refers to a separation of the film elements along a contact plane of the film elements in which the film elements make contact with each other. Furthermore, it is provided that the film elements are designed without any intermediate space on the receiving cavity abutting and projecting from the same. An intermediate space-free region of the film elements, which forms the edge region or the film edge around the receiving cavity, preferably surrounds the receiving cavity. The edge region or the film edge is preferably designed differently in the circumferential direction around the receiving cavity. In a preferred embodiment, the edge region has a wing-like design on one side of the receiving cavity, while the remaining edge region is designed evenly spaced around the receiving cavity. The transition from the wing-like edge region to the even edge region is continuous in one embodiment, and abrupt in another embodiment. The filling orifice is, or the filling orifices are, disposed in the even edge region. The even edge region preferably measures several millimeters in the film plane. In particular, the width of the edge region in the film plane is less than 5 mm, more preferably less than 3 mm, and more preferably less than 2 mm. In the region of the filling orifice, in one embodiment the edge region is wider in the film plane, which is to say in the contact region of the film elements, than the remaining even edge region. The edge region has a considerably smaller surface area and/or volume in the region of the filling orifice compared to the other even edge region. A ratio of the surface areas or of the volumes of the edge region filling orifice to the remaining even edge region is preferably smaller than 0.5:1, preferably smaller than 0.4:1, still more preferably smaller than 0.3:1, furthermore smaller than 0.2:1, and most preferably smaller than 0.1:1, and smaller. The wing-shaped edge region abutting the even edge region is designed in the manner of a pull tab, projecting from the receiving cavity. In one embodiment, the overlapping film elements are designed identically in the region of the wing-shaped region. This means that the wing-shaped edge regions are designed congruently or substantially congruently. In another embodiment, the film elements are designed dissimilarly in the region of the wing-shaped edge region. In this way, only a portion of the one film element is covered by the opposing film region. Opening means are provided for opening the receiving cavity, which allow simplified opening. In one embodiment, the opening means are designed such that these allow one-handed opening. In another embodiment, it is provided that the opening means allow easy two-handed opening. In a further embodiment, it is provided that the opening means allow both one-handed and two-handed opening. The opening means are configured in the wing-shaped edge region in one embodiment, and in particular in an integrated manner. In another embodiment, the opening means are configured in the region of the film elements delimiting the receiving region. In still another embodiment, the opening means are configured in the edge region surrounding the receiving region. Yet another embodiment provides for a combination of the opening means in the edge region, in the wing region and/or in the receiving region. The opening means are designed such that, in one embodiment, these simplify separation of the mutually connected film elements, which is to say severing of the sealed seam, at least in areas provided for this purpose. In another embodiment, the opening means are designed to separate a film element alone, for example in the region in which the same forms the receiving cavity. Another embodiment provides for the opening means to both separate the film elements from each other, and to separate a single film element, which is to say to sever a film element in at least one region. One embodiment furthermore provides for the opening means to be designed to separate the sealed seam. The opening means are preferably integrated into the packaging. To this end, the opening means are designed as mechanical opening means. In another embodiment, the opening means have an electrical, electronic, magnetic, chemical and/or mechanical design. The pull tabs are sealed to each other in the region in which the film elements overlap. In one embodiment, the entire overlapping region is sealed. In a further preferred embodiment, only a portion of the overlapping region is sealed.

A preferred embodiment provides for the region of the sealed, overlapping region to the unsealed, overlapping region to be smaller than 1:1, preferably smaller than 0.75:1, and more preferably smaller than 0.5:1. Preferably, as small an overlapping region as possible is sealed. The sealed joint is provided directly adjacent to the receiving cavity so as to appropriately tightly seal the receiving cavity. Additionally, a sealed joint is created at the edges of the overlapping film elements. An edge region is not sealed, so as to render this easier to grip for opening. To simplify gripping, a remote end of the wing-like region has a split design in one embodiment. This means that the film elements are separated from each other at the remote end. In one embodiment, the distance between the separated film elements is constant. In a preferred embodiment, the distance between the separated film elements is variable. The film elements preferably have a curvature at the end so that the respective film element is easier to grip. The curvatures of the film elements are preferably configured in opposite directions. In an embodiment of the packaging that is able to fly, the edge region is designed similarly to a wing on an airplane. On the outermost edge of the wing-like region, the film elements then protrude from the film plane like wing flaps, whereby the flying qualities and/or the rotational or gliding qualities are improved. Corresponding flow guide means can be provided at the ends, such as nozzles, orifices, moldings, recesses, for example ribs, protuberances and the like. In this way, a corresponding circulation profile can be achieved at the corresponding ends of the wing-like regions.

In one embodiment of the invention, it is provided that a peel-off unit, a pop-off unit and/or a squeeze-off unit is provided as opening means. A peel-off unit within the meaning of the present invention refers to a unit in which the films are at least partially pulled away from each other for opening, and in particular under the action of a pulling force. The film elements are separated along the contact surface thereof in the process. During separation, a corresponding sealed seam, which connects the film elements to each other, is severed. Severing takes place in defined areas for this purpose. Simpler separation or peel-off is possible on a sealed seam weakening than in areas having a reinforced sealed seam. A force transfer must be carried out accordingly unevenly if the sealed seam is to be provided in different sealed seam regions. In one embodiment, the sealed seam is reinforced such that a separation or peel-off is not possible, or is possible only with excessive force expenditure. In one embodiment, a peel-off unit is resealable, such as in the case of adhesive, hook and loop, and/or form-locked connections by way of embossings, clips, snap fasteners, moldings and corresponding recesses and the like. A pop-off unit within the meaning of the present invention is understood to mean a unit in which a film element itself is separated under the action of a force. The separation or pop-off preferably takes place under the action of a force using pressure. A pressure is applied from the outside onto the corresponding film element, which causes the film element to separate, such as burst open, at least partially. Correspondingly, the receiving cavity is preferably pressurized, so that the same can burst open more easily under additional, external pressure. In a preferred embodiment, the packaging cannot be re-closed, or only when using additional means, with a pop-off solution. Another embodiment provides for a re-closable pop-off unit or solution. The pop-off unit is preferably provided for opening the packaging using only one hand. The peel-off unit is preferably provided for opening the packaging using two hands. A squeeze-off unit within the meaning of the present invention is understood to mean a unit in which opening of the packaging takes place under the action of a force on the object inside, which then pushes the force from inside against the sealed seam and separates this in the areas intended for this purpose. Here, a separation of the sealed seam is achieved by the application of a force on the object from the outside by the film elements, and a force transmission from inside against the sealed seam. The packaging is opened and/or the object is removed in a movement that is dependent on the sealed seam and the design of the receiving cavity. In one embodiment, a translatory movement is provided. In another embodiment, a rotatory movement is provided. In other embodiments, a combination of translatory and rotatory movements is provided.

In a further embodiment, at least one pull tab is provided as a peel-off unit, which is formed by the two film elements projecting from the receiving cavity. The pull tab has a symmetrical design having congruent film elements in one embodiment. The plane of symmetry represents the contact surface between the film elements here. In this way, the two film elements have a mirror-symmetrical design with respect to the contact plane of the film elements in the region of the pull tab. In another embodiment, the two parts forming the pull tab have an asymmetrical design. Correspondingly, the film elements do not have a congruent design in the region of the pull tab. One film element deviates from the other film element in the region of the pull tab in terms of shape, material and/or thickness. Opening then takes place similarly to peeling a banana. In other embodiments, the pull tabs are not designed essentially planar, which is to say in one plane, but form a three-dimensional contour, for example in the form of a cylinder. Correspondingly, multiple pull tabs may be configured on the three-dimensional contour, so that a peel-off even more similar to peeling a banana takes place here. In one embodiment, the receiving cavity extends into the wing-like region. In this case, the wing-like region has a three-dimensional structure. So as to create the pull tab, the parts projecting from the receiving cavity, which are tab parts, are welded by way of a sealed seam, wherein a region for gripping and/or for forming a three-dimensional contour or structure having no sealed seam is created. So as to tear the pull tab open, the tab parts are pulled apart, wherein the pull tabs separate in a tear-open direction toward the receiving cavity. The receiving cavity is also exposed by the separation of the film elements. The tab parts are designed for easy force transfer. It is provided in one embodiment that the extension of the pull tabs in the largest extension direction thereof and/or in the tear-open direction is designed to be greater than the largest extension of the receiving cavity in the largest extension direction thereof and/or in the tear-open direction. In other embodiments, a shorter pull tab is provided. The ratio of the extension of the pull tab to the extension of the receiving cavity, each in the largest extension direction thereof and/or in the tear-open direction, preferably in the contact plane, is selected from a ratio of approximately 5:1, preferably approximately 4:1, more preferably approximately 3:1, and most preferably approximately 2:1. In other embodiments, a ratio of 1:1 is provided. The ratios are preferably provided for a packaging including a peel-off unit. In another embodiment, other ratios are provided, preferably for a packaging including a pop-off unit and/or including a squeeze-off unit. In particular, shorter pull tabs are provided here, resulting in ratios of approximately 1:1, 0.9:1, 0.8:1, and up to 01:1 here.

So as to enable easy tearing, a tear-open direction has a curved progression, which is preferably curved in the film plane. The tab parts are only provided on the edge of the parts by way of a sealed seam, in one embodiment. The sealed seam preferably has an even design, which is to say, has a constant cross-section or an even width. In other embodiments, the sealed seam is implemented with a varying cross-section or with an uneven width. The sealed seam is appropriately designed for easy opening.

In another embodiment, at least one predetermined breaking point, an at least sectional sealed seam reinforcement of the sealing weld joint and/or at least one force transfer element is provided as the pop-off unit and/or as the squeeze-off unit. In one embodiment, a predetermined breaking point is formed directly in, and/or on, at least one film element. A predetermined breaking point is preferably provided in each film element so as to form a suitable predetermined breaking point. For example, the predetermined breaking point is created by a thinned material region and/or by a groove, a depression, a notch or the like. In another embodiment, the predetermined breaking point is provided in the sealed seam. Yet another embodiment provides for a predetermined breaking point to be provided both in the sealed seam and in the film element. Furthermore, one embodiment provides for at least one sealed seam reinforcement to be provided. The sealed seam reinforcement is created by an additional embossing in one embodiment. In other embodiments, the sealed seam is created by a larger cross-section in relation to another region of the sealed seam. In further embodiments, a combination of an embossing and a larger cross-section is provided. In one embodiment, multiple sealed seam reinforcements and/or sealed seam weakenings are provided. In a further embodiment, sealed seam reinforcements are provided for a targeted opening of the receiving cavity. In still further embodiments, the sealed seam reinforcement is configured such that this holds the film elements together during a peel-off, pop-off and/or squeeze-off. On the corresponding reinforcement, the sealed seam has an inseparable design using the aforementioned actuations, so that this reinforcement acts as a joint or hinge. The two film elements accordingly remain permanently connected to each other.

In a preferred embodiment, closing elements are provided on the packaging, which allow repeated closing of the packaging. The closing elements are designed, for example, as a hook and loop fastener, as a snap fastener, as a clip closure or the like. In this way, a packaging can be used multiple times.

The sealed seam is designed so as to seal or close the receiving cavity around the periphery. In one embodiment, an interruption of the sealed seam is provided. The interruption is preferably provided on a filling orifice. In a preferred embodiment, a filling orifice that is fluidically connected to the receiving cavity is provided on the packaging. The filling orifice is designed for filling the receiving cavity with a flowable object. Correspondingly, the filling orifice extends into a filling orifice from the receiving cavity up to or beyond the outermost edge of the corresponding portion of the film element, so that filling is facilitated.

The filling orifice is disposed in a location offset in relation to a centroidal axis of the packaging. The centroidal axis is derived from the suspension of the packaging at a point through this point along the centroidal axes of the surrounding gravity field. In another embodiment, the centroidal axis of the packaging is also derived through a center of mass and/or a center of volume of the packaging along the centroidal axes of the gravity field. The filling orifice is preferably disposed laterally offset in relation to the centroidal axis. The filling orifice is preferably disposed with the orientation thereof rotated in relation to the progression of the centroidal axis. In one embodiment, the filling orifice is created in the extended tear-open direction of the pull tab. In another embodiment, the filling orifice extends offset in relation to the tear-open direction. The filling orifice preferably extends not rotated in relation to the tear-open direction. The filling orifice is configured between the film elements in an integrated manner by an intermediate space, and preferably an approximately cylindrical intermediate space. Other intermediate spaces are provided to match a filling device.

Still another embodiment provides for the packaging, and in particular the filling orifice and/or the receiving cavity, to include at least one undercut and/or another molding and/or recess, or for an undercut or a molding and/or a recess to be provided there. The undercut causes the object to be retained when the receiving cavity is being opened. In this way, the object does not inadvertently fall out of the packaging, but remains therein, at least temporarily, even when the packaging is open. The undercut or the molding/recess is preferably integrated with the film element in the region of the filling orifice and/or of the receiving cavity.

The invention further encompasses the technical teaching that, in a method for producing a packaged shaped object, and in particular a packaged object suitable for consumption, such as a food and/or a food product and/or a dietary supplement, in which the at least one packaging is produced according to any one of the above-described methods, it is provided that the receiving cavity is filled with the object through a filling orifice in a liquid and/or flowable form, after the receiving cavity has been shaped, and the filling orifice is closed by way of a sealing weld joint.

In one embodiment, an above-described packaging is provided. A filling device is guided through the filling orifice, for example a filling nozzle or another filling neck. The object is introduced into the receiving cavity through the filling device. The object is flowable and/or fluidic for this purpose. The object may be either gaseous, liquid and/or a combination thereof. The object is preferably implemented as a hardened object. In a preferred embodiment, the receiving cavity is filled with at least two different objects. The receiving cavity is preferably filled simultaneously with the objects at least intermittently. In a preferred embodiment, the receiving cavity is first filled with a first object. With some time delay, a second object is added, so that the receiving cavity is filled simultaneously with two different objects. In a further embodiment, the adding of the second object is stopped before the adding of the first object is stopped, so that the second object is surrounded at least partially, and preferably completely, by the first object in the receiving cavity.

The object is colored in one embodiment. The film element has an at least partially transparent design in the first part, which is to say in the part in which the receiving cavity is formed, so that the object is recognizable from the outside. The object is preferably dyed. In one embodiment, the filling device that is provided is a device comprising two filling channels through which the object flows. The filling channels are configured next to each other in one embodiment. In another embodiment, the channels are configured inside each other, so that an outer channel surrounds an inner channel. In one embodiment, adding is carried out in a separate filling device after the packaging has been completed. In another embodiment, adding takes place integrated in a device for producing the packaging. After the thermoforming process, the receiving cavity is filled with the object, and thereafter is closed on the production device, so that the fully packaged object leaves the production device. In one embodiment, the receiving cavity comprises multiple chambers. In one embodiment, the chambers are filled differently. In one embodiment, one chamber is filled with a liquid or flowable object, and another chamber is filled with a gaseous object. The two chambers are then appropriately closed. Closing is carried out by the film element itself in one embodiment. In another embodiment, a separate closure for at least one chamber is provided. The separate closure is preferably coupled to the film element, so that at least one chamber, and preferably all chambers are also opened when the receiving cavity is opened.

The object is preferably an object intended to be consumed by humans and/or animals. The object is present at least partially in a solid state at room temperature (approximately 20° C.) and at customary ambient pressure levels (around 1 bar). In other embodiments, the object is present at least partially in liquid form under the aforementioned conditions. In one embodiment, the object is present in one state, which is to say solid, liquid or gaseous. In another embodiment, the object is present in multiple states, for example liquid and solid, or liquid and gaseous. The object comprises multiple regions, and preferably an inner region, encapsulated by an outer region. The inner region is preferably provided for a liquid and/or gaseous state. The outer region is preferably provided as a solid state, or else as a gel-like state, such as for a soft capsule. The object is designed as an object that hardens as it cools, for example. In this way, the receiving cavity can be filled with the object in the heated liquid and/or gaseous state through a needle or a nozzle. On cooling, the object accordingly hardens.

In one embodiment, it is provided that the receiving cavity, except for the filling orifice, is sealed by the sealing weld joint before the preferably flowable object is added. In one embodiment, the receiving cavity is sealed except for the filling orifice. Sealing is carried out by way of an even sealed seam in one embodiment. In another embodiment, sealing is carried out by way of a varying sealed seam. The filling orifice is closed after the object or the objects or the material to be added has, or have, been added. In one embodiment, the filling orifice projects over the film element in the form of a shoulder on the film element. The edge region around the receiving cavity, which is to say the first portion of the film elements designed without any intermediate space, is preferably less than 3 mm wide, more preferably less than 2 mm, and most preferably less than 1.5 mm, each being the shortest distance from the outermost edge to the edge located adjacent to the receiving cavity in the film plane or in the contact plane. The region of the filling orifice, which is to say the shoulder in which the filling orifice is provided and which is designed without any intermediate space after the filling process, is preferably smaller than or equal to 3 mm, more preferably smaller than or equal to 2 mm, and most preferably smaller than or equal to 1.5 mm in the shortest extension to the receiving cavity in the film plane. The filling orifice is preferably closed by a reinforced sealed seam, so that the region of the filling orifice acts as a hinge when folding open the packaging.

In one embodiment, the method is designed for soft capsule production. Until now, soft capsules are produced using a rotary die principle. The present method allows the production of soft capsules to be carried out using a mogul technique. The mass for the soft capsules, such as glucose syrup, gelatin or the like, is added directly into the packaging. The mass or the ingredients for the object to be packaged is or are poured into the receiving cavity in liquid form, or in a hot state here. The wall of the receiving cavity in one embodiment includes a starch powder or another coating. In a preferred embodiment, the wall does not comprise any starch powder or other coating and thus has a coating-free design. Upon hardening, for example by way of cooling, the poured object can be removed directly from the packaging, without necessitating complex handling steps. In this way, an improved mogul technique is provided. This allows objects to be generated that have a profile, both on the top side thereof and on the bottom side thereof, depending on the design of the film elements around the receiving cavity. The object does not have a smooth or planar surface, as has previously been the case, due to the liquid state in which the object is poured into the open mold. The liquid object is rather poured into a receiving cavity that is closed, with the exception of the filling orifice, in which the liquid object then hardens or cools. In a further embodiment, another object is poured into the packaging around the liquid first object. In one embodiment, the two objects have differing consistencies at room temperature and/or ambient pressure. In one embodiment, at room temperature, the outer object is in a more solid state than the inner object. In one embodiment, a liquid inner object together with a more solid outer object surrounding the same can thus be produced in the packaging and removed from the same. For example, the outer object is configured in the form of a hard and/or soft capsule, for example. The inner object is a liquid mass, for example, all of this being at room temperature, in a range around this room temperature. The room temperature preferably ranges between 18° C. and 22° C. The range around the room temperature is plus/minus 5° C., and preferably 10° C., for example. A pressure for the above-mentioned information is preferably in the range of 1 bar plus/minus 0.2 bar, and preferably plus/minus 0.1 bar. In one embodiment, none of the objects is produced by way of a foaming method. Both objects are injected through the filling orifice into the otherwise closed receiving cavity via a needle, a nozzle or the like. The needle or nozzle is designed as a double needle in one embodiment. In this design, an outer needle surrounds an inner needle. The receiving cavity is filled with the less hardened object and/or the object that is liquid, or more liquid, at room temperature through the inner needle. The better, and/or more quickly, hardening object, or the object hardening at higher temperatures, which is used as the capsule for the inner object, is poured in through the outer needle. The objects are preferably foodstuffs and/or food products. In other forms, these are pharmaceuticals or the like. Arbitrary objects are conceivable in this regard, preferably objects suitable for being taken or consumed by humans and/or animals. In another embodiment, the above principle is reversed. The object, which will later be solid, is poured in through the inner needle, and the object, which will later be less solid or more liquid, is poured in through the outer needle. Naturally, it is also possible to envelope objects that are gaseous at room temperature with an encapsulating object. In one embodiment, the object is designed to have such a formulation that the object hardens more slowly, or not at all, on an edge layer located adjacent to the film elements. The liquid object is preferably poured in using what is known as a one-shot process. The object to be packaged is, or the objects to be packaged are, injected into the otherwise closed receiving cavity through a filling orifice that is to be sealed thereafter using an injection, for example by way of one, two or more needles, that is carried out simultaneously and/or with a brief time delay, wherein a portion of the injection takes place at least partially simultaneously.

The invention moreover encompasses the technical teaching that, in a packaging, it is provided that the packaging is produced by one of the above-described methods, and in particular that, in a packaging, such as a film packaging having a bubble-like receiving cavity and/or a blister pack, in which at least two film elements overlap, wherein at least one receiving cavity for receiving at least one object to be packaged is shaped between the overlapping film elements, and at least two of the film elements are connected along a shared sealed edge region extending at least partially around the periphery of the receiving cavity, and in particular are connected by way of at least one sealing weld joint, so as to seal the receiving cavity, wherein the two film elements are designed without any intermediate space on the sealed edge region projecting from the same, wherein opening means and/or retaining means are provided, which allow simplified access to the receiving cavity or prevent the packaged object from inadvertently moving out of the receiving cavity. The retaining means comprises moldings, shapings, undercuts, ribs, grooves, and the like. These are integrated with the packaging in one embodiment, and more precisely with the portion of the film elements defining the receiving cavity. The moldings or concave sections preferably project into the receiving cavity, or away from the same, or out of the same. A combination is provided in one embodiment.

The packaging is preferably composed of two film elements, which are connected to each other as separate film elements or as joined elements. The film elements comprise a receiving cavity created in a bubble-like shape by way of thermoforming. Furthermore, the film elements comprise an intermediate space-free region in which the film elements are at least partially sealed. This region forms an edge region around the receiving cavity. A portion of the edge region or of the film region is designed so as to project in a wing-like manner from the receiving cavity. Another portion surrounds the periphery of the receiving cavity in the film plane. This region serves exclusively as the sealed seam. The wing-like portion is only partially configured with a corresponding sealed seam. The sealed seam has a sealed seam reinforcement in at least one location, so that this is more difficult to sever than the remaining sealed seam. In other embodiments, sealed seam weakenings are provided. Furthermore, at least one predetermined breaking point is provided in one embodiment. The predetermined breaking point is provided in the film element in one embodiment. In another embodiment, the predetermined breaking point is provided in the sealed seam and/or the edge region. In other embodiments, a combination is provided. Furthermore, a filling orifice is provided, which extends from the receiving cavity through the otherwise intermediate space-free edge region. In one embodiment, the filling orifice is located offset in relation to a centroidal axis of the packaging, and/or offset in relation to a tear-open direction of the packaging. In another embodiment, the filling orifice is closed by a sealed seam reinforcement. The sealed seam reinforcement is reinforced with an additional embossing in one embodiment. In one embodiment, the wing-like portion is formed by essentially congruent, which is to say mirror-symmetrical, film element sections. In another embodiment, the wing-like portion is formed by two film element sections that are not congruent, which is to say asymmetrical.

The invention also encompasses the technical teaching that, in a shaped object including packaging, it is provided that the shaped object including packaging is produced according to an above-described method, and in particular that in a packaged shaped object, and in particular a packaged object suitable for consumption, such as a food and/or a food product and/or a dietary supplement, including at least one above-described packaging, it is provided that the receiving cavity is filled with the object through a filling orifice in a liquid and/or flowable form, after the receiving cavity has been shaped, and the filling orifice is closed by way of a sealing weld joint. The receiving cavity is preferably filled with one object. The receiving cavity is preferably filled with the object in fluid form through the filling orifice that has not been closed yet. The object is preferably added through a filling nozzle having at least one filling channel through the filling orifice. The receiving cavity is preferably filled with multiple objects. In one embodiment, the receiving cavity comprises multiple chambers, which are filled with different objects. In one embodiment, the chambers are individually closed, for example by way of a lid or the like. In another embodiment, at least one chamber is closed by a film element. The chambers are fluidically separated from each other in one embodiment. The lids or the like are connected to each other in one embodiment, so that when a lid is opened, the further lid connected thereto is opened. In another embodiment, at least one lid is coupled to a film element so that opening of the film element also causes the lid connected thereto to be opened. In one embodiment, the sealed seam closes the receiving cavity and/or the lid closes the corresponding chamber in an air-tight manner, allowing volatile objects to be securely packaged in the receiving cavity as well.

The invention furthermore encompasses the technical teaching that, in a device for producing at least one above-described packaging, comprising at least one film element feed unit for feeding and/or conveying film elements, further comprising at least one forming unit, which deforms fed and overlapping film elements under the action of heat in at least one forming mold so that a receiving cavity is created between the film elements, and comprising a sealing unit, which at least partially seals at least the receiving cavity by way of at least one sealed seam, it is provided that at least one processing unit for providing opening means in the packaging is provided so as to produce an above-described packaging. The device comprises a film element feed unit. This feeds two film elements to a forming unit. The film elements are preferably fed separately. In one embodiment, the film elements are fed together. The film feed unit comprises an unwinding device from which the films are unwound. From the film feed unit, the film elements reach the forming tool. The forming tool operates according to a thermoforming method, in which the film elements are heated and pressed in a forming mold against the mold wall thereof by way of pressure. The application of pressure is carried out by way of positive pressure in one embodiment. In another embodiment, the application of pressure is carried out by way of a vacuum. When a vacuum is applied, appropriate vacuum openings are provided in the wall of the forming mold, which suction in the heated, and thus easily deformable, film element against the mold wall.

In another embodiment, a positive pressure is introduced between the film elements. The introduction of the positive pressure is carried out by way of one nozzle, or multiple nozzles, for example, which are introduced between the film elements. The filling orifice can be shaped by way of the nozzle or nozzles. The nozzles introducing the positive pressure can also be used to introduce the flowable object. In another embodiment, other nozzles or filling devices are used to fill the receiving cavity with the object. Downstream from the thermoforming of the packaging, during which the sealed seam can be implemented, the production device comprises a cutting and/or punching device, by way of which the connected film elements can be separated, whereby a desired shape is achieved. Moreover, in one embodiment, an embossing device is provided, so as to achieve a reinforced sealed seam by way of embossing. Correspondingly, a sealing device is provided. In one embodiment, the sealing device is integrated with the thermoforming device. In another embodiment, the sealing device is integrated with the embossing device.

Furthermore, a processing device is provided. This may be used to provide the opening means in the packaging. In one embodiment, the processing device is integrated with the thermoforming device. The processing device is designed, for example, to create an asymmetrical pull tab. For this purpose, one film element is appropriately processed, so that the same is designed differently from the corresponding film element. The processing device is designed to shape the one film element after this is connected to the other film element. In another embodiment, the processing device is designed to shape the one film element from the connection to the other film element.

Last but not least, the invention also encompasses the technical teaching that, in a device for producing at least one above-described shaped object including packaging, and in particular for producing a packaged shaped object, in particular a packaged object suitable for consumption, such as a food and/or a food product and/or a dietary supplement, using at least one above-described device, at least one filling device is provided, which is suitable for filling the receiving cavity with an object through a filling orifice in a liquid and/or flowable form, after the receiving cavity has been shaped. A corresponding filling device is provided for adding a flowable object. In one embodiment, this comprises at least one nozzle or the like by way of which the receiving cavity can be filled with the fluid through the filling orifice of the packaging. The nozzle comprises at least one filling channel through which the fluid can be introduced into the receiving cavity. The nozzle preferably comprises at least two filling channels by way of which the material to be added can be introduced. In one embodiment, the filling channels are disposed next to each other. In another embodiment, the filling channels are disposed inside each other. One of the filling channels thus surrounds at least one other filling channel. In this way, it is possible to simultaneously introduce even differing fluids into the receiving cavity at least temporarily.

In one embodiment, it is provided that the packaging is designed to carry out a passive flying movement, and in particular a gliding and/or autorotation movement, in free fall. For this purpose, the one portion of the film elements is designed as at least one wing, and in particular at least one gliding wing and/or a rotor blade. The packaging is designed as a film packaging composed of two film elements. Correspondingly, the packaging comprises an upper film half and a lower film half. These are connected to each other. The wing forms a pull tab for opening the receiving cavity.

A packaging within the meaning of the present invention shall in particular be understood to mean a deliberately provided, re-detachable enclosure of a product. The enclosure envelopes the object completely or only partially. Most preferably, the packaging completely seals the object. Depending on the embodiment, the packaging is furthermore suitable for preserving foodstuffs, for example as a result of an air-tight design of the receiving cavity. In one embodiment, the packaging includes a region for identifying the product or the like. For this purpose, a corresponding field or a region to be imprinted or provided with a marking in another manner is provided. In one embodiment, energy-powered signal generators for displays, LEDs, luminaires, acoustic signal generators or the like are provided. For this purpose, the packaging includes a space or section for a power supply unit. The power is supplied by way of solar energy in one exemplary embodiment. For this purpose, a corresponding solar device is provided on the wing, for example. In other embodiments, the power is supplied via a battery, an energy converter converting kinetic energy into electric energy, or the like. The battery is rechargeable, for example, such as by moving the packaging. In one embodiment, a centrifugal switch or the like is provided for switching the power supply unit. In other embodiments, regions for not energy-powered advertising media are provided.

The packaging according to the invention includes at least one receiving cavity into which an object can be placed or injected. In another embodiment, the packaging comprises multiple receiving cavities or chambers. The chambers are separated from each other in one embodiment. In one embodiment, the receiving cavities are separated by the shared film. In other embodiments, the chambers are fluidically connected to each other. The connection is designed as a temporary lid in one embodiment, which can be removed, for example when opening the film packaging and/or during a movement, and in particular a rotation of the packaging.

In one embodiment, the weight of the receiving cavity and the object present therein is higher than the weight of the rotor blade projecting from the receiving cavity. In an embodiment comprising a rotor blade projecting on one side, this weight distribution causes the center of gravity of the entire arrangement to be displaced in the direction of the receiving cavity, whereby the packaging rotates approximately about this center of gravity. The autorotation causes the object, together with the packaging enveloping the same, to slowly fall to the ground in a rotating manner and to be substantially protected from damage. It is thus also possible to place items sensitive to shock in the receiving cavity, such as chocolates. In one embodiment, at least one gliding wing is provided. In this way, it is possible for the packaging, together with the packaged object, to carry out a passive glide, so that the packaging glides slowly to the ground. In total, the packaging comprises means for carrying out a passive flight, which is to say a glide or an (auto)rotation movement, which allows a decelerated impingement of the packaging on a ground. The means for passive flight do not cover parachutes, since these allow only a falling motion. The packaging is brought into a free fall from an airplane or from a distance from the ground, for example. In another embodiment, the packaging is transported from ground into the air, for example tossed or shot, so that the package undergoes a free fall after being transported into the air. With an appropriate transition, the time of the free fall is relatively short, and the packaging transitions into the passive flight, for example a glide, immediately, for example, or after a minimal time period.

The packaging comprises at least one wing. In other embodiments, multiple wings are formed. The packaging comprises at least one receiving cavity. In further embodiments, multiple receiving cavities are provided, and in particular receiving cavities disposed at a distance from each other. The receiving cavities may be fluidically connected to each other or separate from each other.

In one embodiment, the wing is designed eccentrically with respect to the receiving cavity. In the case of multiple wings, the arrangement of the wings is symmetrical in relation to the receiving cavity. In still another embodiment, the wings are designed at least partially asymmetrically in relation to the receiving cavity.

The receiving cavity and the object present therein have a total weight GA, which is preferably a multiple of the weight GR of the wing or rotor blade. The entire packaging has a weight G. Excellent autorotation results were achieved using a weight distribution in which the weight GA was seven to ten times the weight GR. However, other weight ratios have also resulted in good flying characteristics.

In this respect, one embodiment of the present invention provides for the weight GA to be a multiple of the weight GR, especially approximately 1.5 times to approximately 15 times, preferably approximately 5 times to approximately 12.5 times, and most preferably approximately 7 times to approximately 10 times the weight GR.

Yet another embodiment of the present invention provides for the packaging to have a multi-piece design, in particular comprising a separate wing and a separate receiving cavity, which are detachably or fixedly connected to each other. In this way, the receiving cavity and the wing can be produced in separate method steps, for example. It is possible, for example, to accommodate the object in the receiving cavity, and to then connect the receiving cavity to the wing. In another embodiment, packaging is carried out in one packaging step. This means that the object is packaged simultaneously and/or in one method step together with the production step.

In a further embodiment of the present invention, it is provided that the receiving cavity is partially integrated into the wing. In one embodiment, the receiving cavity protrudes into an interior of the wing. In another embodiment, the receiving cavity extends along the outside of the wing. Correspondingly, in one embodiment, the receiving cavity is completely closed with respect to an outside environment. In another embodiment, the receiving cavity is at least partially open with respect to the outside environment. For example, the receiving cavity is defined only by holding means for holding an object to be packaged. In one embodiment, the wing directly abuts the receiving cavity. The wing and the receiving cavity are preferably jointly configured by way of a film element or a second associated film element. The wing part and the receiving cavity part then have a one-piece design.

A further embodiment of the present invention provides for the packaging, and in particular the receiving cavity and/or the wing, to have a tight, and in particular an air-tight and/or a gas-tight, design. A sealed receiving cavity or, for example, when the receiving cavity is integrated into the wing, a sealed wing, thus also allows a liquid, a gas and/or a powder to be packaged using the packaging. In particular, the packaging is designed such that this withstands positive pressure. In this way, an air cushion can be achieved for the packaged object, by way of the packaging. In particular, the packaging is gas-tight up to pressures of preferably approximately 2 MPa, in particular also up to approximately 1 MPa, and most preferably up to approximately 0.5 MPa.

The packaging can advantageously be composed of at least two packaging halves, which can be folded open and closed by way of a hinge, such as an integral hinge or another connecting element, or be connected to each other in another manner. Such a packaging can comprise a detent element on the side opposite the hinge, allowing secure closing. Preferably multiple connecting elements and/or detent elements are provided. In addition, locking bar or closure elements can be provided. The detent elements or connecting elements are designed to allow the packaging to be closed again. The hinge is configured by a reinforced sealed seam in one embodiment. This is reinforced by way of an embossing, for example.

In one embodiment, it is provided that the packaging has a one-piece design. In this way, the packaging, together with the receiving cavity and the wing, can be jointly produced in one production step. Complex assembly steps, such as for connecting the wing to the receiving cavity, are thus eliminated. The object to be packaged is preferably packaged together with the production of the one-piece packaging.

It may be advantageous to produce the packaging from a dimensionally stable biomaterial, and in particular from a renewable resource. For higher stability requirements, the packaging can also be produced from a substantially dimensionally stable plastic material as a one-piece injection-molded part. In one embodiment, it is provided that the material for the film elements has a higher melting point or a higher melting temperature than the liquid object. In this way, the film elements can be deformed by way of thermoforming methods, and an object, which was previously melted, can be added to the packaging, without this being deformed again or effectively damaged by the molten object.

A preferred embodiment of the present invention thus provides for the packaging, the receiving cavity and/or the wing to be made of a thin-walled, dimensionally stable material, and in particular biomaterial, comprising textile materials, woven fabric materials, viscose materials, cellulose materials, starch, corn starch, potato starch, foil, metal foil, plastic foil, paper foil, foil composite, hybrid materials, water-soluble materials, compostable materials, biodegradable materials, rice, corn, gelatin or PLA. In other embodiments, corresponding composite materials or mixtures of these compounds are provided.

The receiving cavity of the packaging serves as the forming mold for the material to be added. Correspondingly, objects can be shaped directly when added into the packaging and do not have to be shaped first and then packaged in separate steps. For directly shaping the object in the packaging, the packaging is coated on the inside thereof in the receiving cavity in one embodiment, so that undesirable adhesion of the object is prevented. The object present therein is completely embraced by the packaging enveloping the same and held in the relative position thereof with respect to the packaging. This is moreover supported by an undercut. The undercut is designed so as to form a constriction and/or a predetermined breaking point for the object to be packaged at the transition from the receiving cavity to the undercut.

One embodiment of the present invention thus provides for the packaging to include a receiving cavity having at least approximately even inside dimensions or an even inside diameter so as to receive a candy, a liquid, a powder, a gas or another object having a predefined outside dimension such as a predefined outside diameter. In one embodiment, fillers are additionally provided in the receiving cavity, optionally in a separate chamber, which are used to at least partially fill the remaining free space between the object and the receiving cavity. In one embodiment, a positive pressure is generated in the receiving cavity. In another embodiment, a portion of the receiving cavity is not filled with the object, but with the filler, for example also air. The receiving cavity is preferably filled at least 85%, more preferably at least 90%, still more preferably at least 95%, and most preferably 99% with the object.

It is furthermore advantageous if the projecting rotor blade or rotor blades has or have a length or a maximum size that is more than three times the diameter or the maximum size of the receiving cavity. Moreover, it is advantageous to dimension the width of the rotor blades so that this ranges between one time to two times the largest receiving cavity dimension.

The receiving cavity can take on arbitrary shapes. Preferably a spherical shape is provided; however other shapes are also conceivable. A polyhedral shape is most preferred.

The at least one wing, and in particular the at least one rotor blade, preferably projects laterally from the receiving cavity. Still another embodiment of the invention provides for the packaging to include transversely extending reinforcement webs at least in the region of the wing, and in particular of the rotor blade. The packaging can have approximately the shape of a winged seed, or samara, such as that of a maple samara or the asymmetrical shape of the samara of the tree of heaven (*Ailanthus altissima*). It is particularly advantageous to configure the packaging with transverse ribs to reinforce the wing surfaces, and in particular the rotor surfaces, when the packaging is composed of a thin-walled material. If the packaging is produced from a thin-walled plastic film, these transverse ribs can be generated by appropriate linear heating webs during the forming process. Other production methods such as compressing, folding, crumpling or the like can also be employed, of course. One embodiment thus provides for the packaging to include transversely extending reinforcement webs at least in the region of the wing, and in particular of the rotor blade. In another embodiment, an edge of the film elements has an increased thickness, so that increased turbulence can develop here.

Moreover, it is provided in one embodiment of the present invention that the receiving cavity comprises opening means for easier opening, for example a perforation, a tear line, a hinge, a material weakening or the like. In this way, opening is simplified for the user, in particular when the material has been tightly packaged. Moreover, inadvertent opening, for example by environmental factors, is prevented.

In a further embodiment of the present invention, a filler is provided in the receiving cavity, the filler at least partially surrounding the object to be packaged, comprising liquids, gases, solids, and in particular pressurized gas such as air, small solid materials and the like. In this way, it is also possible to package heavy objects using the packaging according to the invention. A gas that is lighter than air may then be introduced as a filler for this purpose into the receiving cavity, similarly to the operating principle of an airship. The filler then creates buoyancy. Moreover, suitable fillers allow the impact qualities for landing on the ground to be improved, so that a packaged object is additionally protected. The filler can be produced from any arbitrary material, and in particular from the same material as the packaging. In this way, it is possible to use packaging waste resulting during production of the packaging as fillers.

Still another embodiment of the present invention provides for holding means to be provided on the wing and/or the receiving cavity so as to hold the object to be packaged on the wing or in the receiving cavity. For example, so as to prevent the packaged object from moving during passive flight, holding means are provided, which prevent undesirable movements. The object is held in the receiving cavity, or on or in the wing, in a form-locked and/or force-fit manner, for example. In this way, for example, a portion of the object can be used as a stabilizing means in the wing and/or in the receiving cavity, for example the stick of a lollipop. In one embodiment, for example, a straw is attached to the wing, so that the wing is reinforced by the straw and/or a flow guide means is created by the straw. If a liquid is packaged in the receiving cavity and/or in the wing, which is to say in the packaging, the straw is designed so as to be removable from the wing, and the liquid can be withdrawn from the packaging via the straw.

Moreover, it is provided in a further embodiment of the present invention that the wing comprises flow guide means, comprising a trip wire, nozzle elements, ribs, recesses, moldings, apertures and the like, so as to improve the flying qualities of the packaging. As a result of such means, the flow around the wing and/or incident flow of the wing is adapted to the corresponding situation. When such flow guide means are provided, it is possible, for example, to deliberately use turbulences, laminar flows, turbulent flows, discontinuous flows and the like in a targeted manner.

Moreover, it is provided that the object is packaged in one step together with the production of the packaging, and in particular simultaneously, or that the object is packaged in a separate step from a production of the packaging and/or of the receiving cavity and/or of the wing, and in particular consecutively.

In one embodiment of the invention, a packaging can be produced from two plastic films. The two plastic films are pressed against, pushed against and/or welded to the receiving cavity on both sides by way of a mold. The mold comprises two mold halves in this embodiment, which are moved against each other. The films are advantageously fed here, for example, by synchronous unreeling from two rolls. An object is advantageously to be placed into the receiving cavity either immediately during the production process or later.

In another embodiment, the film is fed from only one roll. Advantageously, it is not necessary to have two rolls operate synchronously, which is very difficult and prone to faults in the case of a film packaging that is to be preferably symmetrically opposed on both sides.

In the case of a material to be packaged including packaging, it is also provided that the packaging is designed as a packaging according to the invention, and the material to be packaged is held in the receiving cavity, for example by way of an undercut.

Preferably after the receiving cavity has been formed, the receiving cavity is filled with the object through a filling orifice in a liquid and/or flowable form, and the filling orifice is closed by way of a sealing weld joint.

Also preferred is a production device comprising at least one film element feed unit for feeding and/or conveying film elements, further comprising at least one forming unit, which deforms fed and overlapping film elements under the action of heat in at least one forming mold so that a receiving cavity is formed between the film elements, and comprising a sealing unit, which at least partially seals at least the receiving cavity by way of at least one sealed seam.

The object to be added preferably comprises two fluids that are liquid when added, wherein the first fluid and the second fluid are introduced into the receiving cavity such that the first fluid at least partially surrounds the second fluid in the receiving cavity, and the second fluid thus forms the core for the first fluid.

One embodiment provides for a packaging, and in particular a film packaging having a bubble-like receiving cavity, and in particular a blister pack, comprising: at least two films that are connected along a shared sealed edge extending at least partially around the periphery, and in particular two films connected to each other by way of at least one sealing weld joint, and at least one receiving cavity for receiving an object to be packaged between the films, wherein on the edge region, projecting from the same, the two films are configured as a pull tab by way of which the two films can be separated from each other along the pull tab and at least partially along the receiving cavity along a tear-open direction so as to gain access to the receiving cavity, wherein the extension of the pull tabs in the tear-open direction is designed to be greater than the extension of the receiving cavity in the tear-open direction.

Moreover, one embodiment provides for a packaging including an object packaged therein, and in particular a packaging including an object that is added in a liquid phase to the receiving cavity, comprising a packaging including a receiving cavity, wherein an object, which was introduced in a liquid phase and has hardened to yield a dimensionally stable object, and in particular a food and/or a food product, is disposed in the receiving cavity. Furthermore, one embodiment provides the production of a packaged object having a shape, comprising the following steps: filling a shaping receiving cavity of a packaging with the object in a liquid phase, and hardening the object in the packaging, so that the same transitions into a dimensionally stable phase.

A further embodiment provides a method for producing a packaging, and in particular a film packaging having a bubble-like receiving cavity, comprising the following steps: connecting at least two films along a peripheral, shared sealed edge, in particular by way of at least one sealing weld joint, wherein at least one edge region is left unconnected, and shaping a receiving cavity for receiving an object to be packaged, in particular through the edge region, wherein at least one undercut cavity, in which the object to be packaged can be held, is created in the receiving cavity adjacent to the unconnected edge region. The undercut cavity is also referred to more concisely as an undercut.

Furthermore, it is provided that at least one edge region of the film (elements) is left unconnected, in particular so as to fill the receiving cavity through the same.

The receiving cavity is preferably designed symmetrically with respect to the film plane. Toward the outside, which is to say in the film elements, the receiving cavity preferably has a profile, and in particular a three-dimensional profile. This means that the receiving cavity is defined by film elements that have a profile including appropriate moldings and recesses. The receiving cavity itself is thus configured as a forming mold for the shaped object to be poured in.

The object is preferably packaged in one step together with the production of the packaging, and in particular simultaneously.

In one embodiment, it is provided that the object is packaged in a separate step from a production of the packaging and/or of the receiving cavity and/or of the wing, and in particular consecutively, during production of the packaging including the packaged object.

According to the invention, a production and packaging method for soft capsule products including liquid or semi-solid materials to be added is thus provided. Improved production of the packaging and of the soft capsule is provided. The packaging and the soft capsule including materials to be added are produced in an optimized process. Similarly to the blow molding of beverage bottles (PET), forming processes (heating, shaping) are carried out in the novel production and packaging method. In the next steps, the packaging is filled with the material to be added. After the filling process, the packaging is sealed and further shaping steps are carried out. In addition to a reduced complexity (time savings, less handling), a significant conservation of resources is achieved. As a result, the energy expenditure is significantly lowered. A packaging involving fewer material types is provided. The energy-intensive hard aluminum foil according to the prior art is replaced. Preferably a packaging involving fewer material types is used, which requires fewer separation processes or is biodegradable. At least one predetermined breaking point is provided. Within the meaning of the invention, the predetermined breaking point also covers a predetermined bending point, which is to say an area in which the film elements buckle more easily under the action of a force than in other areas of the packaging, and in particular in the region of the receiving cavity. The object and/or the corresponding receiving cavity preferably has a wedge shape, having a more pointed section in the region of the filling orifice and a thicker area in the region of the wing-like edge region.

In one embodiment, it is provided that the pull tab, as seen looking in the sealed seam plane, is not located in the extended direction (180°) with respect to the filling orifice, but transversely thereto. A primary direction of the filling orifice in the sealed seam plane, together with the tear-open direction of the pull tab in the sealed seam plane, forms an angle in the sealed seam plane that, measured counterclockwise, ranges between 5° and 355° excluding the range of 180°+/−5°. The angle preferably ranges between 5° and 40°, 50° and 175°, 185° and 310°, and 320° and 355°. More preferably the angle is in a range greater than 50° to smaller than 310°, excluding the range of 180°+/−5°. In a preferred embodiment, the angle ranges between 60° and 160° and/or 200° and 300°. The pull tab is preferably located transversely to the filling direction in an opposite side, which is to say at angles greater than 90° and smaller than 270°.

In a further embodiment, the shape of the pull tab is bent or curved. In particular, an edge of at least one pull tab, and in particular of both cooperating pull tabs, is curved or bent. The pull tabs preferably have an asymmetrical or non-congruent design, so that a portion of the one pull tab is designed not to be covered by the adjoining other pull tab. Preferably all edges of the pull tabs are bent or curved. In one embodiment, the uncovered surface area is in a range of greater than 10% of the entire surface area of the pull tab, more preferably greater than 20%, still further greater than 30%, furthermore greater than 40%, further preferably greater than 50%, and most preferably greater than 60% of the entire uncovered surface area. The narrower pull tab is preferably designed to have a primary extension in the tear-open direction, which is to say a longitudinal pull tab. Due to the large fraction of uncovered surface area, a relatively large surface area is available here for imprints such as warning labels, advertisement and the like on the pull tab. Due to the narrow elongated shape, the narrower pull tab which can be gripped sufficiently easily allows effortless handling. The uncovered surface area is preferably greater than 60% of the entire pull tab surface area.

Further measures improving the invention are described herein or will be apparent from the following description of exemplary embodiments of the invention, which are shown schematically in the figures. Uniform reference numerals are used for identical or similar components or features. Features or components of different embodiments can be combined so as to obtain further embodiments. All of the features and/or advantages that are described here, the description or the drawings, including design details, arrangement in terms of space, and method steps, can thus be essential to the invention, both alone and in a wide variety of combinations.

BRIEF DESCRIPTION OF THE DRAWINGS

FIG. 10 shows a schematic perspective view of the packaging according to FIG. 8 and FIG. 9 in a third state;

FIG. 11 shows a schematic perspective view of another embodiment of a packaging when closed;

FIG. 12 shows a schematic side view of another embodiment of a packaging when closed;

DETAILED DESCRIPTION OF THE INVENTION

Figure 1:
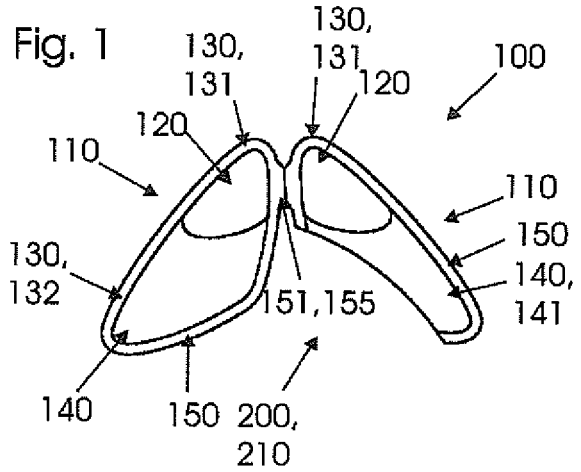
FIG. 1 shows a schematic top view onto a folded-open packaging comprising a peel-off unit including an asymmetrical pull tab.

The figures show various embodiments of a packaging 100 composed of two overlapping film elements 110 in various views and various levels of detail. The two overlapping film elements 110 form a receiving cavity 120 between them, which is created between the film elements 110 by way of thermoforming. Around the receiving cavity 120, the packaging comprises an edge region 130, which is formed by the film elements 110 and in which the film elements 110 abut each other without any intermediate space. A portion 131 of the edge region 130 is formed evenly around the receiving cavity 120, and another portion 132 extends away from the receiving cavity 120 in a wing-like manner. The transition between the two portions 131 and 132 is flowing or continuous, so that a transition region 133 is formed here, in which a clear separation between the portions 131 and 132 is not shown in a precisely defined manner. Other embodiments provide a clear separation having no transition region 133. The packaging 100 comprises opening means 200 for easier opening of the packaging 100. These are integrated into the packaging in the exemplary embodiments shown here.

FIG. 1 shows a schematic top view onto a folded-open packaging 100 comprising an opening means 200 designed as a peel-off unit 210. The peel-off unit 210 comprises a portion 132 of the edge region 130, which is designed as a pull tab 140. The pull tab 140 is designed as an asymmetrical pull tab 141. The film elements 110 abutting each other without any intermediate space are designed to be congruent here. One portion 132 is narrower, so that a region of the other film element 110 is visible in the folded-closed state. This asymmetrical design of the pull tab 140, 141 allows a simplified peel-off, which is to say a simplified separation of the film elements 110, to be achieved. In the shown embodiment, the portion 132 is longer in the longest extension thereof than the receiving cavity 120 is in the longest extension thereof, both viewed in the film plane, which is to say in the contact plane of the film elements 110. This results in favorable force conditions during peel-off. The film elements 110 are connected to each other by way of a sealed seam 150. The sealed seam is not configured in a planar manner across the entire film element 110, but only along an edge of the film element 110. In the exemplary embodiment shown in FIG. 1, the sealed seam 150 comprises a reinforced section of the sealed seam 150 or a sealed seam reinforcement 151. During a peel-off process, the two film elements 110 remain connected at the sealed seam reinforcement 151 when folded open, so that the reinforced sealed seam 151 acts as a hinge 155 between the film elements 110. The sealed seam 150 is configured so as to extend around the entire periphery of the wider film element 110. In the narrower film element 110, the sealed seam 150 does not extend around the entire periphery, but is interrupted. The interruption is configured on the portion 132. In this way, easier opening and a lower material consumption are achieved.

The packaging 100 shown in FIG. 1 has approximately the shape of a maple samara when folded together. The portion 132 projects from the receiving cavity 120 in the form of a rotor blade, which ensures that the packaging 100 thus designed carries out an autorotation during free fall and floats slowly to the ground.

Figure 2:
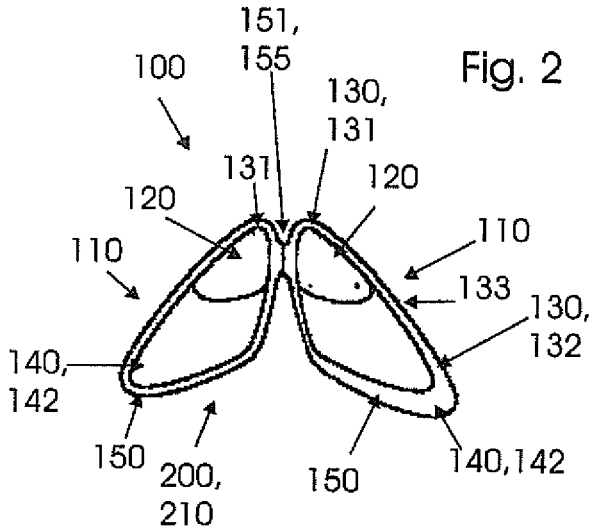
FIG. 2 shows a schematic top view onto a folded-open packaging comprising a peel-off unit including a different pull tab.

FIG. 2 shows a schematic top view onto a folded-open packaging 110 including an opening means 200 comprising a peel-off unit 210, including a different embodiment of a pull tab 140. The two parts 132 forming the pull tab 140 have an approximately congruent design, so that they are congruently seated on each other when folded together. In this way, a symmetrical pull tab 142 is formed. On one film element 110, the sealed seam 150 is designed differently from the other film element 110 for simplified peel-off. In this way, a user can separate the two film elements 110 more easily from each other.

Figure 3:
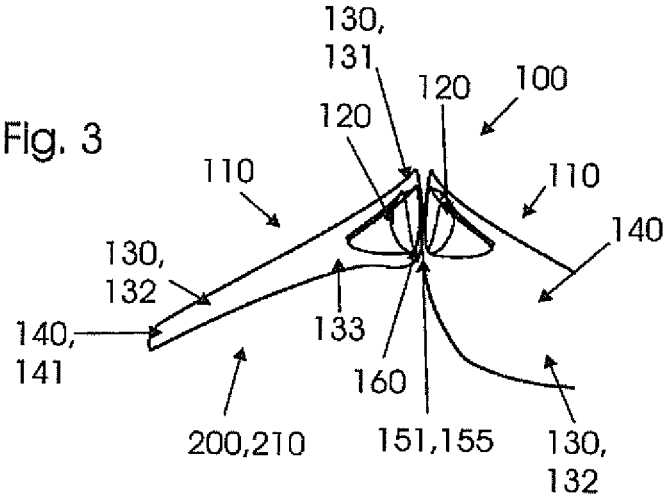
FIG. 3 shows another schematic view of the embodiment according to FIG. 1.

FIG. 3 shows another schematic view of the embodiment according to FIG. 1. The receiving cavity 120 extends spanning beyond the film plane. A sealed filling orifice 160 is located approximately on the side of the receiving cavity 120 located opposite the side of the pull tab 140. The filling orifice 160 is disposed offset in relation to a centroidal axis (not shown here). Moreover, the filling orifice 160 is closed by way of the sealed seam 150, wherein the sealed seam 150 comprises a sealed seam reinforcement 151 so as to create a hinge 155, which is in the form of an integral hinge here. The film elements 110 form an asymmetrical pull tab 141.

Figure 4:
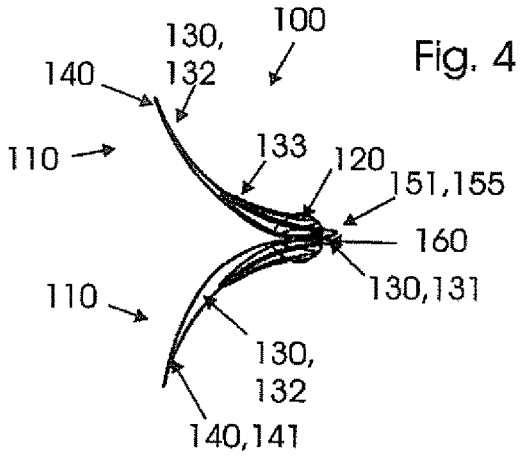
FIG. 4 shows another schematic view of the embodiment according to FIG. 3 in a partially folded-open state.

FIG. 4 shows another schematic view of the embodiment according to FIG. 3 in a partially folded-open state. The film elements 110 are made of a pliable material or have a corresponding material thickness, so that the film elements can be bent. A peel-off process is shown, in which the film elements 110 are separated from each other in the region of the pull tab 140 by the action of a force, wherein the sealed seam 150 is also separated in this region. The film elements are bent, or elastically bent here. The pull tab 140 is designed in one piece with the portion 131 that defines the receiving cavity 120. The sealed seam 150 extends across the portions 131, 132, and optionally 133. Separating the sealed seam 150 during the peel-off opens the receiving cavity 120 and grants access to the interior thereof.

Figure 5:
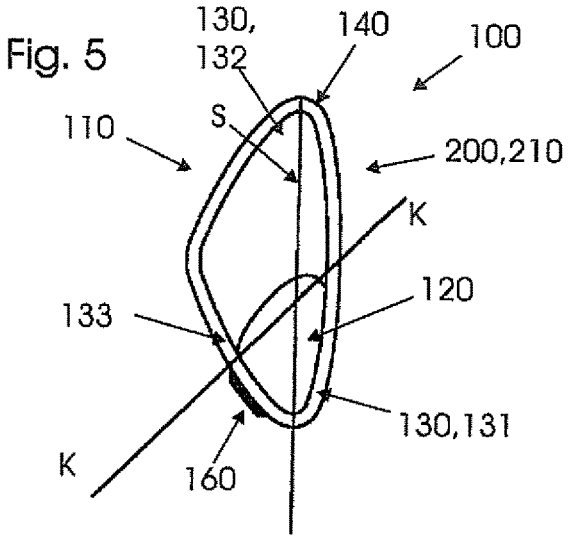
FIG. 5 shows a schematic top view onto the embodiment according to FIG. 1 when folded together.

FIG. 5 shows a schematic top view onto the embodiment according to FIG. 1 in a folded state. The location of the sealed filling orifice 160 is shown clearly here. This is located offset in relation to a centroidal axis S of the packaging. The filling orifice 160 is closed by way of a sealed seam 150, which comprises a sealed seam reinforcement 151, in the form of an additional embossing here. The sealed filling orifice 160 protrudes beyond the peripheral edge of the packaging, which is to say the filling orifice 160 does not end flush with the remaining edge. The filling orifice protrudes several millimeters in the exemplary embodiment, and by less than 3 millimeters in the present example.

This protrusion allows a simpler filling process to be achieved. Moreover, the protrusion of the filling orifice 160 is needed for the sealed seam reinforcement 151. The packaging 100 has an approximately triangular design in the film plane. The receiving cavity 120 is disposed in a corner region of this triangular shape, adjacent to the filling orifice 160. The filling orifice forms a filling channel 161 along the direction K, which is configured obliquely with respect to the centroidal axis S here. The direction of K is located approximately at an angle of 45° with respect to the centroidal axis S. The channel, or the direction K thereof, is disposed such that this points approximately in the direction of gravity, which is to say in the direction of the Earth's center, when the packaging 100 is opened by the pull tabs 140. Other angles are possible.

Figure 6:
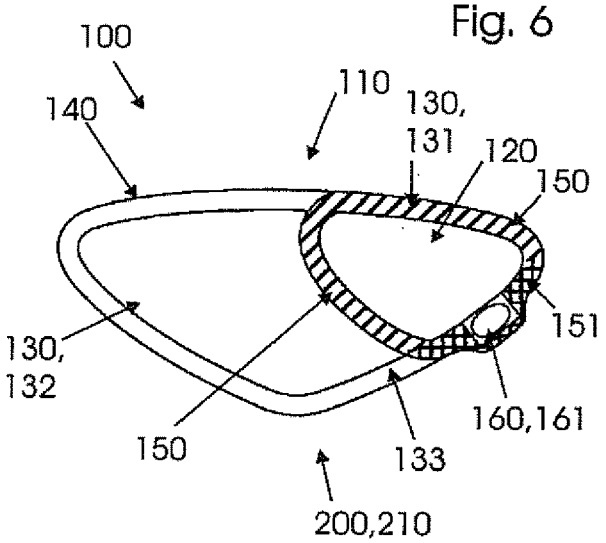
FIG. 6 shows a schematic, partially cut top view onto the embodiment according to FIG. 5.

FIG. 6 shows a schematic, partially cutaway top view onto the embodiment according to FIG. 5. It is clearly apparent here how the sealed seam 150 surrounds the periphery of the receiving cavity 120 in the film plane so as to seal the receiving cavity 120 formed between the film elements 110. The filling orifice 160 is designed approximately as an oval channel 161, which is closed to the outside by the sealed seam 150 and the sealed seam reinforcement 155. Here, the sealed seam 150 comprises the sealed seam reinforcement 151 not only on the protruding portion, but also on the edge located laterally next to the filling orifice 160.

Figure 7:
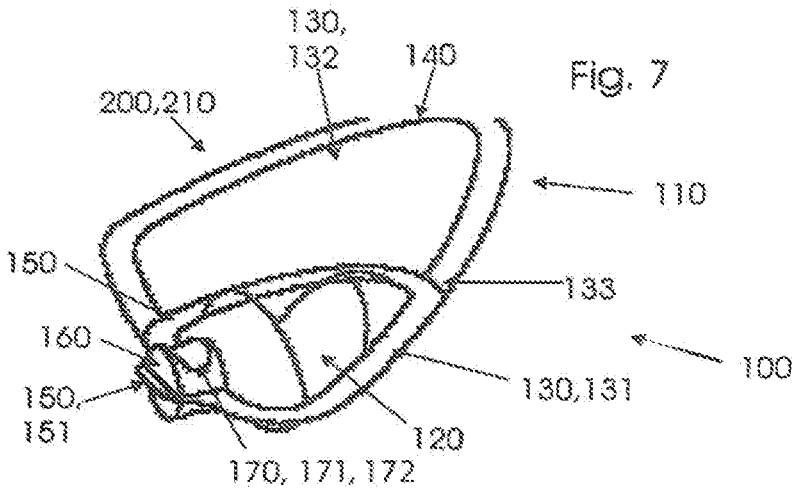
FIG. 7 shows a schematic perspective view of one embodiment of the packaging including an undercut.

FIG. 7 shows a schematic perspective view of one embodiment of the packaging 100 including an undercut 170. The packaging 100 essentially corresponds to the exemplary embodiment according to FIG. 6. The filling orifice 160 is fluidically connected to the receiving cavity 120. The channel 161 of the filling orifice 160 has an undercut 170, which here is present in the form of a depression or trough 171. In this way, a retaining means 172 is formed, retaining an object, which is injected into the receiving cavity 120 and the filling orifice 160 and hardened there, when the packaging 100 is being opened, so that the object does not inadvertently find its way out of the opened packaging. The undercut is configured in the region of the filling orifice 160 here. The sealed seam reinforcement defines a tear opening or a direction for removing an object. This is carried out in a direction in which the filling orifice or the channel thereof extends.

Figure 8:
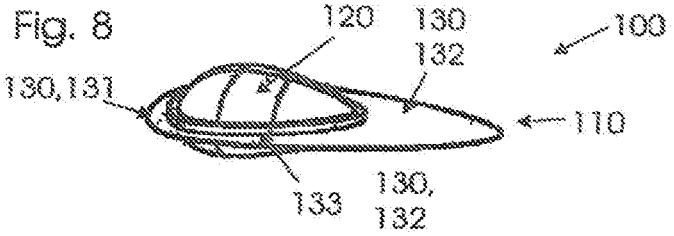
FIG. 8 shows a schematic perspective view of a packaging comprising a pop-off unit in a first state.
Figure 9:
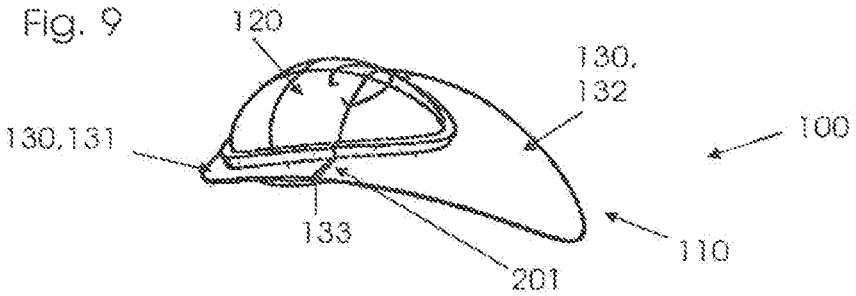
FIG. 9 shows a schematic perspective view of the packaging according to FIG. 8 in a second state.

FIG. 8 shows a schematic perspective view of a packaging 100 comprising a pop-off unit in a first state. FIG. 9 shows a schematic perspective view of the packaging 100 according to FIG. 8 in a second state. FIG. 10 shows a schematic perspective view of the packaging according to FIG. 8 and FIG. 9 in a third state.

FIGS. 8 to 10 schematically show the opening process of the packaging 100 during a pop-off. During a pop-off process, the film elements 110 are bent jointly on both sides from the receiving cavity 120 in a shared direction, so that the film element 110 experiences tension in the region of the receiving cavity 120. If the tension is sufficiently high, the film element 110 bursts open in the region of the receiving cavity 120 and exposes the receiving cavity. So as to support this pop-off opening process, an opening means 200 in the form of a predetermined breaking point 201 is provided in one embodiment. The predetermined breaking point 201 is a thinned material region in a film element 110, for example, preferably in the region of the receiving cavity 120 or in the transition from the receiving cavity 120 to the film element 110 having no intermediate space. In the present example, the sealed seam 150 comprises a sealed seam weakening 153, so that the sealed seam 150 opens in this region. The film elements 110 thus remain re-usable.

FIG. 11 shows a schematic perspective view of another embodiment of the packaging 100 when closed. In this embodiment comprising the pop-off unit 240, a predetermined breaking point 201, in the form of a slot 202, which is introduced into the film elements 110 on both sides next to the receiving cavity 120, is provided as the opening means 200. With a corresponding force action, the opening of the packaging 100 is supported by this predetermined breaking point 201.

Figure 13:
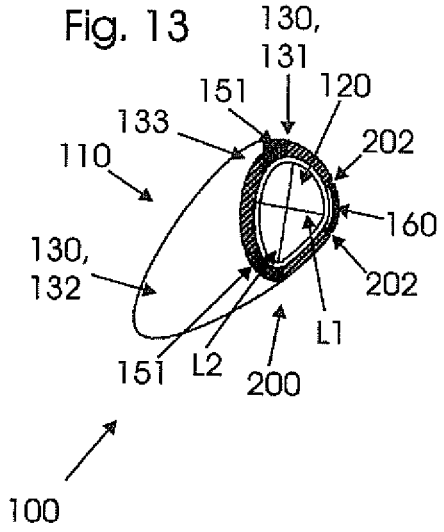
FIG. 13 shows a schematic, partially cut top view onto a packaging including a first embodiment of a sealed seam.
Figure 14:
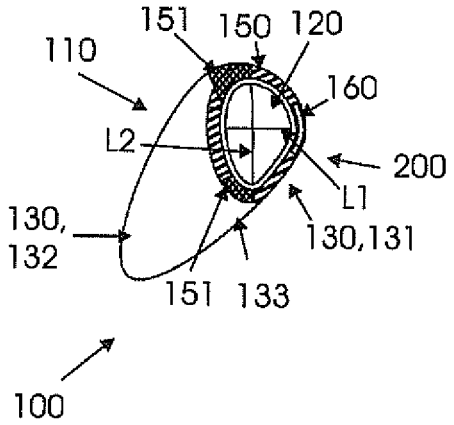
FIG. 14 shows a schematic, partially cut top view onto a packaging including a second embodiment of a sealed seam.
Figure 15:
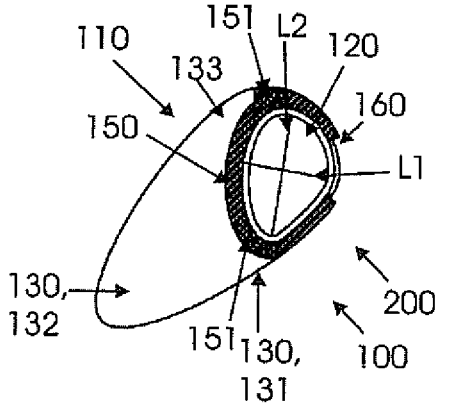
FIG. 15 shows a schematic, partially cut top view onto a packaging including a third embodiment of a sealed seam.

FIG. 12 shows a schematic side view of a further embodiment of the packaging 100 when closed. The packaging 100 essentially corresponds to the packaging 100 shown in FIGS. 8 to 11 and can be implemented with or without a slot 202. As a further opening means 200, a recess or depression 203 in the form of a trough is introduced into one film element in the embodiment according to FIG. 12. This trough 203 acts as an undercut 170. Additionally, this trough 203 is provided for the action of a force, for example using a finger. It is possible to direct the action of the force by way of the trough 203. Together with an appropriately configured sealed seam 150 having corresponding sealed seam reinforcements 151 and corresponding sealed seam weakenings, targeted opening of the packaging 100 can thus be achieved. FIGS. 13 to 15 show different embodiments of sealed seams 150.

FIG. 13 shows a schematic, partially cutaway top view onto a packaging 100 including a first embodiment of a sealed seam 150. FIG. 14 shows a schematic, partially cutaway top view onto a packaging 100 including a second embodiment of a sealed seam 150. FIG. 15 shows a schematic, partially cutaway top view onto a packaging 100 including a third embodiment of a sealed seam 150. The sealed seam 150 extends around the periphery of the receiving cavity 120.

In the exemplary embodiment shown in FIG. 13, the sealed seam 150 comprises two sealed seam reinforcements 151. These are disposed on different sides of the receiving cavity 120 and disposed at a distance from each other by the respective sealed seam 150. Proceeding from the filling orifice 160, a line L1 is shown in the filling direction L1. A second line L2 is shown approximately perpendicularly thereto. In this way, the receiving cavity 120 is divided into four quadrant-like regions. In the film plane, the first sealed seam reinforcement 151 is located in an approximately ten-thirty to twelve o'clock position. The sealed filling orifice 160 is located approximately in the two to four o'clock position. The second sealed seam reinforcement 151 is located approximately in the six o'clock to seven-thirty position. The sealed seam 150 is provided in the other regions around the receiving cavity 120. This arrangement brings about targeted opening during a pop-off process. Laterally next to the filling orifice 160, a respective slot 202 is provided. This allows the filling orifice 160 to be opened, as shown in FIG. 16.

In the exemplary embodiment shown in FIG. 14, the sealed seam 150 comprises two sealed seam reinforcements 151. These are disposed on different sides of the receiving cavity and disposed at a distance from each other by a respective sealed seam 150. Proceeding from the filling orifice 160, a line L1 is shown in the filling direction L1. A second line L2 is shown approximately perpendicularly thereto. In this way, the receiving cavity 120 is divided into four quadrant-like regions. In the film plane, the first sealed seam reinforcement 151 is located approximately in a ten-thirty to twelve o'clock position. The sealed filling orifice 160 is located approximately in the two to four o'clock position. The second sealed seam reinforcement 151 is located approximately in the six o'clock to seven-thirty position. The sealed seam 150 is provided in the other regions around the receiving cavity 120. This arrangement bring about targeted opening during a pop-off process.

In the exemplary embodiment shown in FIG. 15, the sealed seam 150 comprises the two sealed seam reinforcements 151. These are disposed on different sides of the receiving cavity 120 and disposed at a distance from each other by the respective sealed seam 150. Proceeding from the filling orifice 160, a line L1 is shown in the filling direction L1. A second line L2 is shown approximately perpendicularly thereto. In this way, the receiving cavity 120 is divided into four quadrant-like regions. In the film plane, the first sealed seam reinforcement 151 is located approximately in a ten-thirty to twelve o'clock position. The sealed filling orifice 160 is located approximately in the two to four o'clock position. The second sealed seam reinforcement 151 is located approximately in the six o'clock to seven-thirty position. The sealed seam 150 is provided in the other regions around the receiving cavity 120. This arrangement brings about targeted opening during a pop-off process. In the region of the filling orifice 160, the film element 110 is removed between the slots 202 here, so that a liquid or a powder can thus be moved out of the receiving cavity, for example.

Figure 16:
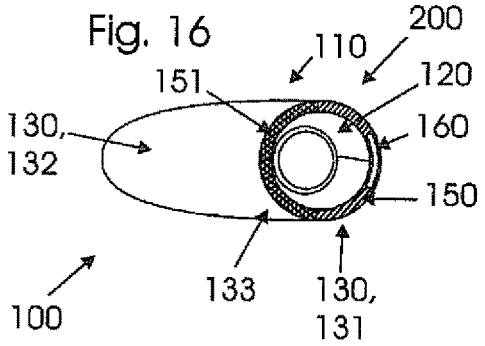
FIG. 16 shows a schematic, partially cut top view onto another embodiment of a packaging including another embodiment of a sealed seam.
Figure 17:
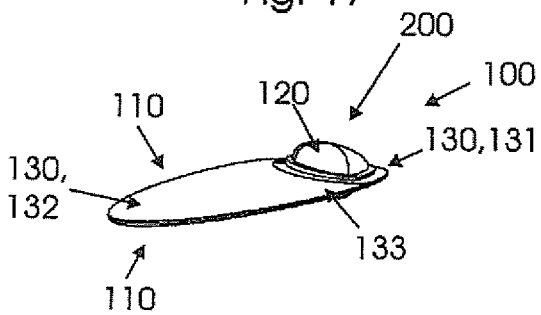
FIG. 17 shows a schematic perspective view of the embodiment according to FIG. 16.
Figure 18:
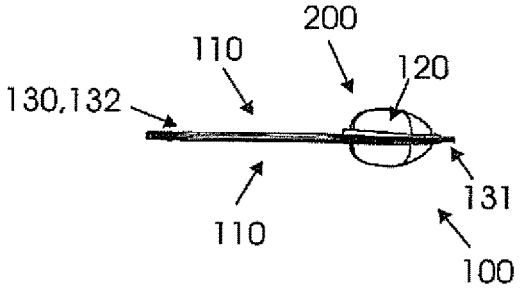
FIG. 18 shows a schematic side view of the embodiment according to FIG. 17.

FIG. 16 shows a schematic, partially cutaway top view onto another embodiment of a packaging 100 including another embodiment of a sealed seam 150. FIG. 17 shows a schematic perspective view of the embodiment according to FIG. 16. FIG. 18 shows a schematic side view of the embodiment according to FIG. 17. FIGS. 16 to 18 show a packaging 100, which has a more oval shape in the top view. The receiving cavity 120 has an approximately circular design in the film plane. The sealed seam 150 for closing the receiving cavity 120 correspondingly runs in a circular manner in the film plane. On the region of the sealed seam 150 facing the portion 132, the sealed seam includes a sealed seam reinforcement 151. The sealed seam reinforcement 151 has an approximately semicircular design. Adjoining is the non-reinforced sealed seam 150, which also closes the region of the filling orifice 160. A depression 203, which also acts as an undercut 170, is provided in the film element 110 in the region of the receiving cavity 120. By the action of a force via the depression 203, a packaged object can be pushed in the direction of the filling orifice 160. As a result of this action of a force, the sealed seam 150 opens in the region of the filling orifice 160 and exposes the receiving cavity 120. The sealed seam 150 remains closed on the sealed seam reinforcement 151, thus forming a hinge 155. The opening is carried out in a squeeze-off process here. This means that the packaging comprises a squeeze-off unit (trough, sealed seam reinforcement), by way of which an object can be removed from the receiving cavity 120 by the application of force in the form of a "squeezing" process. The removal takes place by way of a linear movement of the object, a rotatory movement of the object, or a combination of the two.

Figure 19:
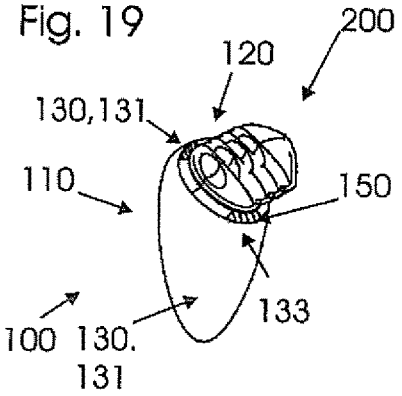
FIG. 19 shows a schematic illustration of a pop-off process of a packaging.

FIG. 19 schematic an illustration of a pop-off process/squeeze-off process of a packaging 100. Here, the two sealed seam reinforcements 151 define a possible movement direction of the object in the packaging 100.

Figure 20:
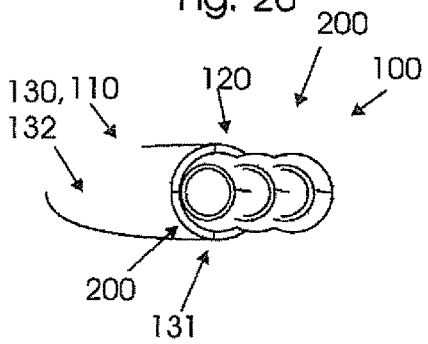
FIG. 20 shows another view of the pop-off process according to FIG. 19.

FIG. 20 shows another view of the squeeze-off/pop-off process according to FIG. 19. As is apparent here, the object is pushed out of the receiving cavity 120 by way of a linear movement.

Figure 21:
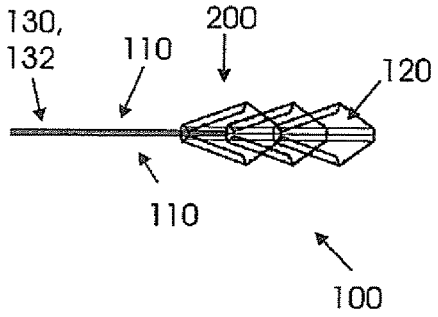
FIG. 21 shows still another view of the pop-off process according to FIG. 20.

FIG. 21 shows still another view of the squeeze-off/pop-off process according to FIG. 20. It is apparent from the side view how the object is displaced along the film plane.

Figure 22:
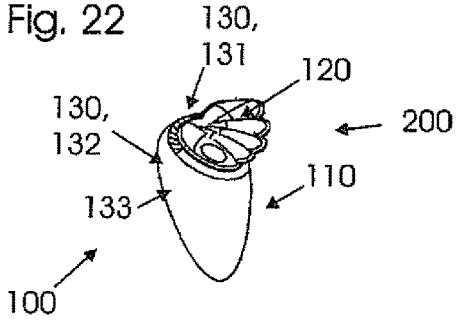
FIG. 22 shows a schematic illustration of another pop-off process of a packaging.

FIG. 22 shows a schematic illustration of another squeeze-off/pop-off process of a packaging 100. Here, the movement of the object is not translatory, but rotatory. The sealed seam 150 is designed accordingly, so that this allows only opening by way of a rotatory movement, but not by way of a translatory movement. The flow of the force is directed in a targeted manner here by a defined depression and a corresponding sealed seam.

Figure 23:
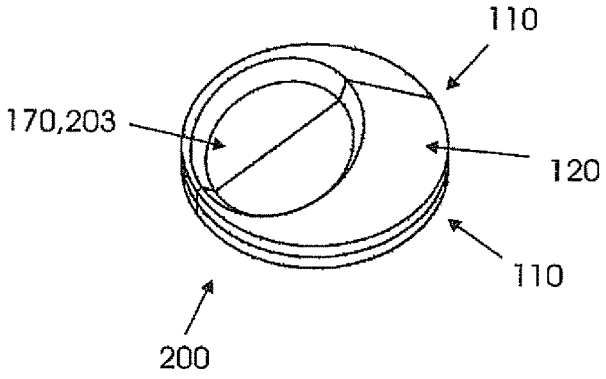
FIG. 23 shows a schematic perspective view of a packaging in another embodiment.

FIG. 23 shows a schematic perspective view of a packaging 100 in another embodiment. Here, the film elements 110 are shown only as a receiving cavity without a protruding edge region. Here, the trough 203 is disposed on a surface area of the film elements 110 that is configured obliquely in relation to the film plane, in the region of the receiving cavity 120. The trough 203 acts both as an undercut 170 and as a force transfer aid for targeted force transfer. The oblique arrangement directs a force component in the direction of the filling orifice.

Figure 24:
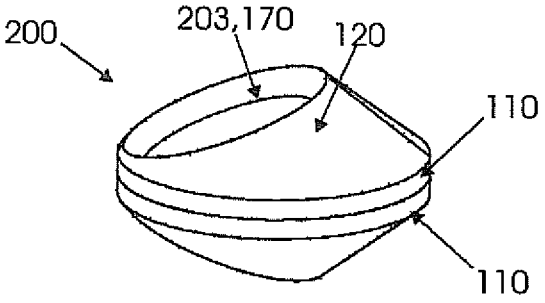
FIG. 24 shows another schematic perspective view of the packaging according to FIG. 23.
Figure 25:
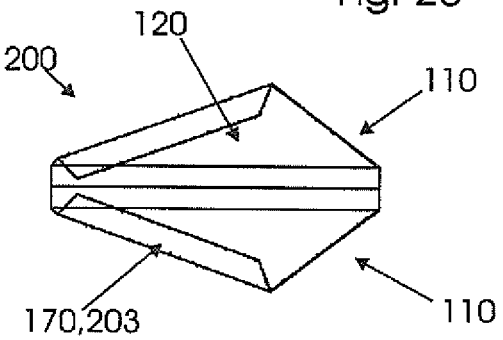
FIG. 25 shows a schematic side view of the packaging according to FIG. 24.

FIG. 24 shows another schematic perspective view of the packaging 100 according to FIG. 23, and FIG. 25 shows a schematic side view of the packaging 100 according to FIG. 24.

The packaging 100 is configured as a dimensionally stable packaging that can be folded open and closed and may be made of plastic material or another dimensionally stable material. The two halves of the packaging 100 are pivotably connected to each other by way of the hinge designed as an integral hinge. The two shaped regions of the film elements 110, which form the receiving cavity 120, envelope the receiving cavity 120, from which the portion 132 designed as a rotor blade projects, for example.

An opening notch is formed between the receiving cavity 120 and the rotor blade, for example, which simplifies opening the receiving cavity 120. The two halves can be connected via a sealed seam 150 configured as a weld or adhesive seam. Furthermore, a reinforcing vein may extend in the longitudinal direction of the rotor blade. On the side opposite the integral hinge, a detent element may be provided, which is not shown in greater detail here, and detachably connects the two rotor blade halves to each other when the packaging is closed.

So as to increase the rigidity of the rotor blade, laterally transversely extending reinforcement webs are configured on the rotor blade in one embodiment, which can be designed as accordingly thick-walled ribs in the case of a plastic packaging. Corresponding reinforcement webs can also be formed only by linear partial melting under the action of heat or by way of embossing.

The object to be placed into the receiving cavity, such as a candy, can be placed into the receiving cavity during the production process or else later. The mold halves are moved against each other during the thermoforming operation so as to create the shape of the packaging. The film webs are unreeled from two rolls preferably synchronously and can be placed against the shapes of the mold halves by way of a vacuum or negative pressure, or a positive pressure. The peripheral outside edges are welded together by the action of heat. Another embodiment of the device for producing a packaging from two plastic films provides for film webs to only be unrolled from one roll. This has the advantage that it is not necessary for two rolls to run synchronously with each other. In one embodiment, the packaging 100 includes an asymmetrical receiving cavity, from which a longer and a shorter rotor blade each project. The packaging is created in one embodiment from an unelastically deformable film, and preferably a metal foil. An elastic foil is preferred. Accordingly, the option exists to produce the packaging 100 from a biomaterial or a plastic material. The receiving cavity is preferably designed such that an object can be inserted therein in a self-clamping manner. However, the receiving cavity can essentially also be provided with a cover or an enclosure that envelopes the receiving cavity.

LIST OF REFERENCE NUMERALS

100 packaging
110 film element
120 receiving cavity
130 edge region
131 portion of the edge region (even)
132 portion of the edge region (wing-like)
133 transition region
140 pull tab
141 asymmetrical pull tab
142 symmetrical pull tab

150 sealed seam
151 sealed seam reinforcement
153 sealed seam weakening
155 hinge
160 filling orifice
161 channel
170 undercut
171 depression, trough
172 retaining means
200 opening means
201 predetermined breaking point
202 slot
203 depression, trough
210 peel-off unit
240 pop-off unit
270 squeeze-off unit
L1 line (filling direction)
L2 line

The invention claimed is:

1. A packaging comprising at least two film elements which overlap, at least one receiving cavity for receiving at least one object to be packaged, shaped between the overlapping film elements, wherein the at least two film elements are connected along a shared sealed edge region extending at least partially around the periphery of the receiving cavity by way of at least one sealing weld joint, so as to seal the receiving cavity, and wherein the two film elements are designed without any intermediate space on the sealing edge region projecting from the two film elements, a filling orifice which forms a filling channel adjacent to and fluidically connected to the receiving cavity, an opening means configured to allow simplified access to the receiving cavity, and a retaining means configured to prevent the packaged object from inadvertently moving out of the receiving cavity, wherein the retaining means comprises moldings that protrude into the filling channel such that when the receiving cavity receives the at least one object through the filling channel in a liquid and/or flowable form, the object may be hardened there and retained by the retaining means, wherein the at least one sealing weld joint includes a sealed seam reinforcement in at least a region of the sealing weld joint, the sealed seam reinforcement being configured to operate as a hinge when the packaging is opened.

2. A packaged object including the packaging according to claim 1, wherein the receiving cavity is filled with an object suitable for consumption through the filling orifice in a liquid and/or flowable form, after the receiving cavity has been shaped, and the filling orifice is closed by way of the at least one sealing weld joint.

3. The packaged object according to claim 1, wherein the sealed seam reinforcement is in a region of the filling orifice.

4. The packaged object according to claim 2, wherein the sealed seam reinforcement is in a region of the filling orifice and the filling orifice is closed by way of the sealed seam reinforcement.

5. The packaging according to claim 1, wherein the sealed seam reinforcement is reinforced by way of an embossing.

6. The packaging according to claim 1, wherein the filling orifice is offset in relation to a centroidal axis of the packaging.

7. The packaging according to claim 1, wherein a width of the shared sealed edge region in a film plane is less than 5 mm.

8. The packaged object according to claim 2, wherein the sealed seam reinforcement is reinforced by way of an embossing.

9. The packaged object according to claim 2, wherein the filling orifice is offset in relation to a centroidal axis of the packaging.

10. The packaged object according to claim 2, wherein a width of the shared sealed edge region in a film plane is less than 5 mm.

* * * * *